US009101252B2

(12) United States Patent
Conrad

(10) Patent No.: US 9,101,252 B2
(45) **Date of Patent: *Aug. 11, 2015**

(54) CONFIGURATION OF A SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 456 days.

This patent is subject to a terminal disclaimer.

(21) Appl. No.: 13/039,984

(22) Filed: Mar. 3, 2011

(65) Prior Publication Data

US 2012/0222248 A1 Sep. 6, 2012

(51) Int. Cl.

| | |
|---|---|
| ***A47L 9/16*** | (2006.01) |
| ***A47L 5/36*** | (2006.01) |
| ***A47L 9/00*** | (2006.01) |

(52) U.S. Cl.

CPC . *A47L 5/362* (2013.01); *A47L 9/00* (2013.01); *A47L 9/009* (2013.01); *A47L 9/1683* (2013.01)

(58) Field of Classification Search

CPC ..... A47L 9/1683; A47L 9/00; A47L 9/009
USPC ..... 15/327.1–327.7, 362, 412, 347, 350
See application file for complete search history.

(56) References Cited

U.S. PATENT DOCUMENTS

| | | | | |
|---|---|---|---|---|
| 1,613,250 A | | 1/1927 | Spielman | |
| 1,856,133 A | | 5/1932 | McClatchie | |
| 2,064,587 A | | 12/1936 | Carlstedt | |
| 2,135,036 A | | 11/1938 | Karlstrom | |
| 2,224,202 A | | 12/1940 | Smellie | |
| 2,280,269 A | | 4/1942 | Sparklin | |
| 2,533,057 A | | 12/1950 | Senne | |
| 2,550,384 A | | 4/1951 | Senne | |
| 2,621,756 A | * | 12/1952 | Senne | 55/356 |
| 2,632,524 A | * | 3/1953 | Senne | 55/356 |

(Continued)

FOREIGN PATENT DOCUMENTS

| | | |
|---|---|---|
| CA | 2659212 | 9/2010 |
| CA | 2420497 | 6/2011 |

(Continued)

OTHER PUBLICATIONS

U.S. Appl. No. 12/722,673, filed Mar. 12, 2010.

(Continued)

*Primary Examiner* — Lee D Wilson
*Assistant Examiner* — Henry Hong
(74) *Attorney, Agent, or Firm* — Philip C. Mendes da Costa; Bereskin & Parr LLP/S.E.N.C.R.L. s.r.l.

(57) ABSTRACT

A surface cleaning apparatus comprises an air flow path extending from a dirty air inlet to a clean air outlet. The surface cleaning apparatus comprises a main body comprising a front end, a rear end, first and second opposed sidewalls, and a suction motor provided in the air flow path. A cyclone bin assembly may be provided in the air flow path. The cyclone bin assembly may have opposed end walls and may comprise a cyclone chamber having a diameter. Each of the first and second opposed sidewalls may comprise a wheel having a diameter larger than the diameter of the cyclone chamber.

29 Claims, 16 Drawing Sheets

(56) References Cited

U.S. PATENT DOCUMENTS

| | | | | |
|---|---|---|---|---|
| 2,686,330 | A | 8/1954 | Wales | |
| 2,716,465 | A | 8/1955 | Meyerhoefer | |
| 2,769,996 | A | 11/1956 | Shalvoy et al. | |
| 2,811,737 | A | 11/1957 | Hayba | |
| 2,918,693 | A | 12/1959 | Gasparini | |
| 3,015,122 | A * | 1/1962 | Cook | 15/327.4 |
| 3,085,221 | A | 4/1963 | Kelly | |
| 3,457,744 | A | 7/1969 | Bisbing | |
| 3,870,486 | A | 3/1975 | Eriksson et al. | |
| 3,886,616 | A | 6/1975 | Hayes | |
| 5,144,716 | A | 9/1992 | Watanabe et al. | |
| 5,214,822 | A | 6/1993 | Sakurai et al. | |
| 5,254,019 | A | 10/1993 | Noschese | |
| 5,268,845 | A | 12/1993 | Startup et al. | |
| 5,297,311 | A | 3/1994 | Puri | |
| 5,402,059 | A | 3/1995 | Bittar | |
| 5,694,029 | A | 12/1997 | Hayes et al. | |
| 5,742,153 | A | 4/1998 | McEachern et al. | |
| 5,798,633 | A | 8/1998 | Larsen et al. | |
| 5,831,420 | A | 11/1998 | Myers | |
| 6,031,357 | A | 2/2000 | Yano et al. | |
| 6,080,022 | A | 6/2000 | Shaberman et al. | |
| 6,081,104 | A | 6/2000 | Kern | |
| 6,141,822 | A | 11/2000 | Riviera-Boklund et al. | |
| 6,256,832 | B1 | 7/2001 | Dyson | |
| 6,307,358 | B1 | 10/2001 | Conrad | |
| 6,345,411 | B1 | 2/2002 | Kato et al. | |
| 6,425,931 | B1 | 7/2002 | Groggon | |
| 6,532,620 | B2 | 3/2003 | Oh | |
| 6,536,073 | B2 | 3/2003 | Uratani et al. | |
| 6,613,129 | B2 | 9/2003 | Gen | |
| 6,818,036 | B1 * | 11/2004 | Seaman | 55/426 |
| 6,891,355 | B2 | 5/2005 | Kernahan | |
| 6,902,596 | B2 | 6/2005 | Conrad | |
| 6,909,266 | B2 | 6/2005 | Kernahan et al. | |
| 6,929,516 | B2 | 8/2005 | Brochu et al. | |
| 6,976,885 | B2 | 12/2005 | Lord | |
| 7,162,770 | B2 | 1/2007 | Davidshofer | |
| 7,198,656 | B2 | 4/2007 | Takemoto et al. | |
| 7,210,192 | B2 | 5/2007 | Ito et al. | |
| 7,276,099 | B2 | 10/2007 | Hayashi et al. | |
| 7,291,193 | B2 | 11/2007 | Oh et al. | |
| 7,381,233 | B2 | 6/2008 | Oh et al. | |
| 7,425,225 | B2 | 9/2008 | Genn et al. | |
| 7,547,337 | B2 | 6/2009 | Oh et al. | |
| D600,416 | S * | 9/2009 | Shin et al. | D32/21 |
| 7,581,286 | B2 * | 9/2009 | Choi | 15/352 |
| 7,770,256 | B1 | 8/2010 | Fester | |
| 7,780,752 | B2 | 8/2010 | Cha et al. | |
| 7,879,121 | B2 | 2/2011 | Oh | |
| 7,882,592 | B2 | 2/2011 | Hwang et al. | |
| 7,921,962 | B2 | 4/2011 | Liddell | |
| 8,062,398 | B2 | 11/2011 | Luo et al. | |
| 8,296,900 | B2 | 10/2012 | Conrad | |
| 8,418,311 | B2 | 4/2013 | Trydegard et al. | |
| 8,484,799 | B2 | 7/2013 | Conrad | |
| 8,528,160 | B2 | 9/2013 | Conrad | |
| 8,650,708 | B2 | 2/2014 | Dyson et al. | |
| 2001/0048295 | A1 | 12/2001 | Joch | |
| 2002/0059689 | A1 | 5/2002 | Kato et al. | |
| 2002/0073663 | A1 | 6/2002 | Sepke et al. | |
| 2002/0088209 | A1 | 7/2002 | Stephens et al. | |
| 2002/0178701 | A1 | 12/2002 | Oh et al. | |
| 2003/0106182 | A1 | 6/2003 | Lee | |
| 2003/0140444 | A1 | 7/2003 | Soejima et al. | |
| 2003/0173940 | A1 | 9/2003 | Kovarik et al. | |
| 2003/0200622 | A1 | 10/2003 | Park et al. | |
| 2004/0051510 | A1 | 3/2004 | Saggini et al. | |
| 2004/0095118 | A1 | 5/2004 | Kernahan | |
| 2004/0163201 | A1 * | 8/2004 | Murphy et al. | 15/327.2 |
| 2004/0194249 | A1 | 10/2004 | Lee et al. | |
| 2004/0216266 | A1 | 11/2004 | Conrad | |
| 2005/0011039 | A1 | 1/2005 | Barker et al. | |
| 2006/0016043 | A1 | 1/2006 | Matsuhashi et al. | |
| 2006/0080947 | A1 | 4/2006 | Lee et al. | |
| 2006/0101610 | A1 | 5/2006 | Oh et al. | |
| 2006/0156509 | A1 | 7/2006 | Luebbering et al. | |
| 2006/0213023 | A1 * | 9/2006 | Hare et al. | 15/327.2 |
| 2007/0067945 | A1 | 3/2007 | Kasper et al. | |
| 2007/0077810 | A1 | 4/2007 | Gogel et al. | |
| 2007/0079585 | A1 * | 4/2007 | Oh et al. | 55/345 |
| 2007/0151072 | A1 | 7/2007 | Lee et al. | |
| 2007/0200540 | A1 | 8/2007 | Hashimoto et al. | |
| 2007/0226947 | A1 | 10/2007 | Kang et al. | |
| 2007/0251048 | A1 | 11/2007 | Choi | |
| 2007/0256272 | A1 | 11/2007 | Kim | |
| 2007/0289266 | A1 | 12/2007 | Oh | |
| 2008/0104793 | A1 | 5/2008 | Kang et al. | |
| 2008/0134460 | A1 | 6/2008 | Conrad | |
| 2008/0172821 | A1 * | 7/2008 | Kang et al. | 15/327.5 |
| 2008/0172992 | A1 | 7/2008 | Conrad | |
| 2008/0178416 | A1 | 7/2008 | Conrad | |
| 2008/0191675 | A1 | 8/2008 | Besser et al. | |
| 2008/0196194 | A1 | 8/2008 | Conrad | |
| 2008/0196196 | A1 * | 8/2008 | Conrad | 15/353 |
| 2008/0196198 | A1 | 8/2008 | Labarbera et al. | |
| 2008/0216282 | A1 | 9/2008 | Conrad | |
| 2008/0256744 | A1 | 10/2008 | Rowntreer et al. | |
| 2008/0263813 | A1 | 10/2008 | Han et al. | |
| 2008/0295466 | A1 | 12/2008 | Cha et al. | |
| 2009/0000054 | A1 | 1/2009 | Hampton | |
| 2009/0106932 | A1 | 4/2009 | Courtney | |
| 2009/0205160 | A1 | 8/2009 | Conrad | |
| 2009/0205161 | A1 | 8/2009 | Conrad | |
| 2009/0205298 | A1 | 8/2009 | Hyun et al. | |
| 2009/0205299 | A1 | 8/2009 | Oh | |
| 2009/0241286 | A1 | 10/2009 | Hwang et al. | |
| 2009/0266382 | A1 | 10/2009 | Hwang et al. | |
| 2009/0300873 | A1 | 12/2009 | Grey | |
| 2009/0313783 | A1 | 12/2009 | Nakano et al. | |
| 2010/0043170 | A1 * | 2/2010 | Ni | 15/352 |
| 2010/0083833 | A1 | 4/2010 | Morphey | |
| 2010/0154367 | A1 | 6/2010 | Luo et al. | |
| 2010/0175217 | A1 | 7/2010 | Conrad | |
| 2010/0175219 | A1 | 7/2010 | Soen | |
| 2010/0212104 | A1 | 8/2010 | Conrad | |
| 2010/0224073 | A1 | 9/2010 | Oh et al. | |
| 2010/0242208 | A1 | 9/2010 | Gammack et al. | |
| 2010/0242210 | A1 | 9/2010 | Conrad | |
| 2010/0242211 | A1 | 9/2010 | Sunderland et al. | |
| 2010/0242217 | A1 * | 9/2010 | Sunderland et al. | 15/347 |
| 2010/0242222 | A1 | 9/2010 | Conrad | |
| 2010/0243158 | A1 | 9/2010 | Conrad | |
| 2010/0299865 | A1 | 12/2010 | Conrad | |
| 2010/0299866 | A1 | 12/2010 | Conrad | |
| 2011/0146024 | A1 | 6/2011 | Conrad | |
| 2012/0222245 | A1 | 9/2012 | Conrad | |
| 2012/0222262 | A1 | 9/2012 | Conrad | |

FOREIGN PATENT DOCUMENTS

| | | | | |
|---|---|---|---|---|
| CN | 201529088 | U | 7/2010 | |
| EP | 885585 | | 12/1998 | |
| EP | 1674009 | A2 | 6/2006 | |
| EP | 1952743 | | 8/2008 | |
| EP | 2201875 | A2 | 6/2010 | |
| JP | 2002/355198 | * | 12/2002 | A47L 9/00 |
| JP | 2002355198 | | 12/2002 | |
| JP | 2010227287 | A | 10/2010 | |
| WO | 9522190 | | 8/1995 | |
| WO | 9619294 | | 6/1996 | |
| WO | 0364566 | | 4/2003 | |
| WO | 0390596 | | 6/2003 | |
| WO | 2004008932 | | 1/2004 | |
| WO | 2004041054 | | 5/2004 | |
| WO | 2007136675 | | 11/2007 | |
| WO | 2008070962 | | 6/2008 | |
| WO | 2008070965 | | 6/2008 | |

(56) References Cited

FOREIGN PATENT DOCUMENTS

| | | | |
|---|---|---|---|
| WO | 2009026709 | | 3/2009 |
| WO | 2009053676 | A2 | 4/2009 |
| WO | 2010102396 | | 9/2010 |
| WO | 20100112880 | A1 | 10/2010 |
| WO | 2011054106 | | 5/2011 |

OTHER PUBLICATIONS

Toshiba Leading Innovation: "VC-Z100L", [database online], [retrieved on Feb. 15, 2011], retrieved from http:/www.toshiba.co.jp/living/cleaners/vc?z1001/index_j.htm.

Toshiba Escargot Vacuum: "3rings: A Product Blog for Architecture + Design", [retrieved on Feb. 15, 2011], retrieved from http://3rings.designerpages.com/2009/12/28/toshibas-escargot-vacuum/.

Toshiba Escargot vacuum, [retrieved on Feb. 15, 2011], retrieved from http://www.designboom.com/weblog/cat/16/view/8533/toshiba-escargot-vacuum.html.

International Search Report and Written Opinion received in relation to International Patent Application No. PCT/CA2012/000185, mailed Jun. 28, 2012.

International Search Report in relation to International Patent No. PCT/CA2012/000194. dated Jun. 19, 2012.

International Search Report in relation to International Patent No. PCT/CA2012-000184, dated Jun. 6, 2012.

* cited by examiner

CONFIGURATION OF A SURFACE CLEANING APPARATUS

FIELD

The disclosure relates to surface cleaning apparatuses, such as vacuum cleaners.

INTRODUCTION

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one aspect, a surface cleaning apparatus is provided with a main body comprising first and second opposed sidewalls wherein each of the first and second opposed sidewalls comprises a wheel having a diameter larger than the diameter of the cyclone chamber. Accordingly, the surface cleaning apparatus may be rollingly supported by side wheels. One side wheel may be rotatably connected to each sidewall.

An advantage of the design is that the side wheels may have a diameter to permit the surface cleaning apparatus to easily travel over carpet.

Another advantage of this configuration may be that the side wheels and/or the sidewalls of the surface cleaning apparatus can help protect the cyclone bin assembly from side impacts, when the cyclone bin assembly is in the cavity.

In addition to the side wheels, the surface cleaning apparatus can comprise one or both of a front stabilizer wheel and a rear stabilizer wheel. The front and rear stabilizer wheels are provided on opposite sides of the axis of rotation of the side wheels. The surface cleaning apparatus is preferably configured so that only one of the front and rear stabilizer wheels rests on the ground at a time.

Optionally, at least one of the first and second opposed sidewalls has a compartment that houses an operating component of the surface cleaning apparatus or a portion of the air flow path. For example, the compartment may house one or more operating components of the surface cleaning apparatus, including, for example filters, controllers, power sources and cord wrap spools. Preferably one or more-pre-motor filters are positioned in the compartment, between the sidewall and its corresponding side wheel. Alternately, or in addition, the compartment may comprise part or all of the air flow passage from the air outlet of an air treatment member (e.g., a cyclone chamber) to a suction motor inlet. A compartment may be behind each wheel. Further, one or more compartments may be defined between a sidewall and its corresponding side wheel.

The side wheels may be openably mounted to the sidewalls. Removing the side wheels may allow a user to access the compartments in the sidewalls. By removing or moving a wheel to an open position, a user may be able to inspect, clean and/or replace the components. By removing or opening a wheel, a user may be able to inspect, clean and/or replace the components and/or remove a clog in the air flow passage.

An advantage of this configuration is that a more compact surface cleaning apparatus may be provided. The use of space in the sidewalls enables additional portions of the main body of a surface cleaning apparatus on which an air treatment member is provided, and preferably removably mounted, to be used to house components that may need access from time to time.

Another advantage of this configuration may be that a user can access operational components and/or pre-motor of the surface cleaning apparatus when the side wheels are detached from the sidewalls.

The surface cleaning apparatus comprises an air treatment member, which may be a cyclone bin assembly, which may be removably mounted within a cavity on the surface cleaning apparatus. The cavity may be provided laterally between opposing sidewalls of the surface cleaning apparatus. The surface cleaning apparatus sidewalls are preferably large enough to cover the transverse faces of the cyclone bin assembly.

A filter housing, e.g., a post-motor filter housing, can be positioned laterally between the sidewalls, and may be provided in front of, or behind, the cyclone bin assembly. Portions of the filter housing can form part of the outer surface of the surface cleaning apparatus. The filter housing can be positioned so that at least a portion of the filter housing is positioned within the diameter of the side wheels.

The sidewall defining the pre-motor filter compartment may comprise a removable portion of a suction motor housing, surrounding the suction motor. Removing the portion of suction motor housing allows the suction motor to be accessed. The removable portion of suction motor housing is accessible when the side wheel and pre-motor filters are removed.

The compartment may be sealed with a seal plate positioned between the sidewall and the side wheel. The seal plate is preferably transparent to allow visual inspection of the component in the compartment, e.g., a pre-motor filter. The seal plate is preferably removable to allow access to the pre-motor filter. The side wheel overlying the seal plate may comprise an inspection window.

An advantage of this configuration may be that a user can visually inspect the pre-motor filter without having to remove the seal plate or the side wheel overlying the pre-motor filter.

Another advantage of this configuration may be that transparent seal plate allows a user to visually inspect the pre-motor filter without having to remove the seal plate.

Another advantage of this configuration may be that the removable seal plate allows a user to access the pre-motor filter and the removable portion of the suction motor housing.

In accordance with this aspect, a surface cleaning apparatus comprises an air flow path extending from a dirty air inlet to a clean air outlet. The surface cleaning apparatus comprises a main body comprising a front end, a rear end, first and second opposed sidewalls, and a suction motor provided in the air flow path. A cyclone bin assembly may be provided in the air flow path. The cyclone bin assembly may have opposed end walls and may comprise a cyclone chamber having a diameter. Each of the first and second opposed sidewalls may comprise a wheel having a diameter larger then the diameter of the cyclone chamber.

The wheels may be substantially the same size as the sidewalls.

The wheels have a cross sectional area larger then a transverse cross sectional area of the cyclone bin assembly.

The main body may comprise first and second opposed sidewalls. A compartment, such as a filter compartment, may be provided in one of the sidewalls. The sidewalls may overlie at least 50%, more preferably at least 60% and most preferably at least 75% of end walls of the cyclone bin assembly and the side wheels may overlie at least 50%, more preferably at least 60% and most preferably at least 75% of the sidewalls. In a preferred embodiment, the sidewalls overlie essentially all of the end walls of the cyclone bin assembly and/or the side wheels overlie essentially all of the sidewalls. The filter may have a cross sectional area that is at least 50%, more preferably at least 60% and most preferably at least 75% of a cross sectional area of the sidewall.

The surface cleaning apparatus may comprise a cavity having an open upper end positioned between the first and second opposed side walls and the cyclone bin assembly may be removably mounted in the cavity.

The cyclone bin assembly may sit on a platform in the cavity and the platform may comprise a portion of a housing for the suction motor.

The cavity may be generally U shaped.

The cavity may have an open front end and an open rear end.

The cyclone bin assembly may comprise a cyclone chamber and an openable dirt collection chamber. One of the end walls may bean openable wall of the dirt collection chamber.

The cyclone bin assembly may comprise a cyclone chamber that extends transversely. The cyclone chamber may comprise a tangential inlet that is provided at the front end of the surface cleaning apparatus.

The main body may comprise a suction hose connector upstream of the tangential inlet.

The main body may comprise a suction hose connector upstream of the cyclone bin assembly.

The cyclone bin assembly may comprise a cyclone chamber and a dirt collection chamber. The dirt collection chamber may be provided exterior to the cyclone chamber and extends at least partially collinearly therewith.

The cyclone bin assembly may comprise a cyclone chamber and a dirt collection chamber. The surface cleaning apparatus further may comprise a pre-motor filter which may have a cross sectional area that is larger then a transverse cross sectional area of the cyclone chamber.

The pre-motor filter may be provided in one of the first and second opposed sidewalls.

The pre-motor filter may have a cross sectional area that is at least 60% of a cross sectional area of the sidewall.

The pre-motor filter may have a cross sectional area that is proximate that of the sidewall.

At least one of the first and second opposed sidewalls may have a compartment that houses an operating component of the surface cleaning apparatus or a portion of the air flow path.

The portion of the airflow path may comprise at least part of an air flow passage between the cyclone chamber and the suction motor.

The cyclone bin assembly may comprise a cyclone chamber and the suction motor and the cyclone chamber extend transversely.

The operating component may comprise at least one of a filter, batteries, a power cord reel and control electronics.

The operating component may comprise at least one of batteries, a power cord reel and control electronics.

The compartment may be openable.

Each of the first and second opposed sidewalls may comprise a wheel and at least one of the wheels may be openable to reveal the compartment.

The surface cleaning apparatus may comprise at least one of a front stabilizer wheel and a rear stabilizer wheel.

The surface cleaning apparatus may comprise a front stabilizer wheel and a rear stabilizer wheel. The stabilizer wheels may be positioned such that only one wheel can contact the floor at a time.

DRAWINGS

Reference is made in the detailed description to the accompanying drawings, in which.

Figure 1:
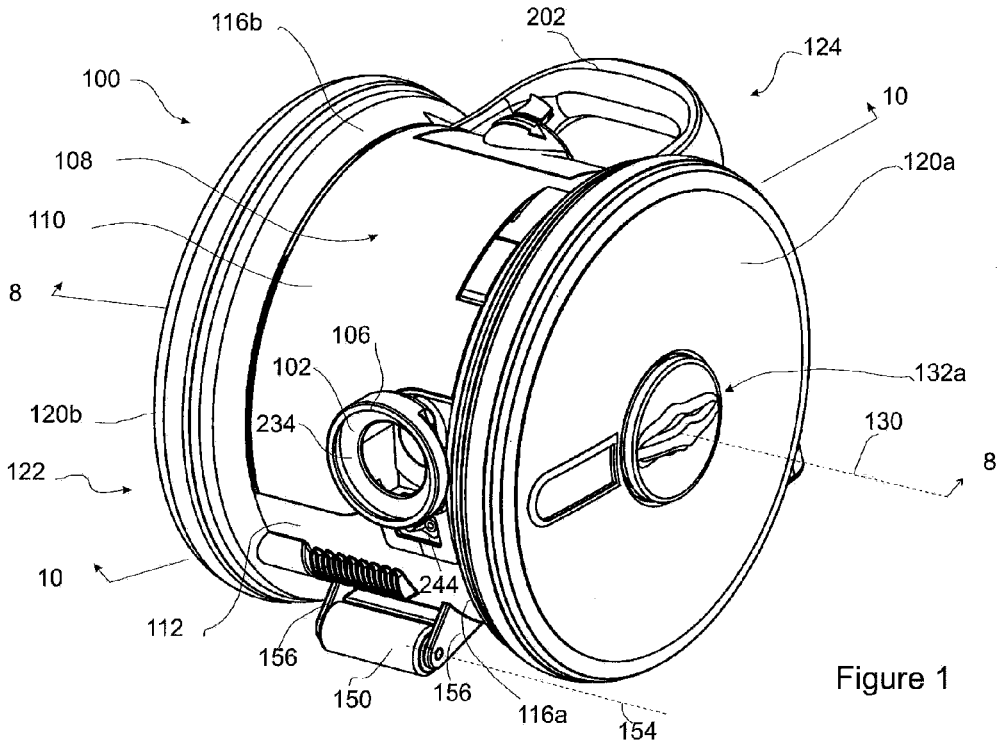
FIG. 1 is a front perspective view of an embodiment of a surface cleaning apparatus.
Figure 7:
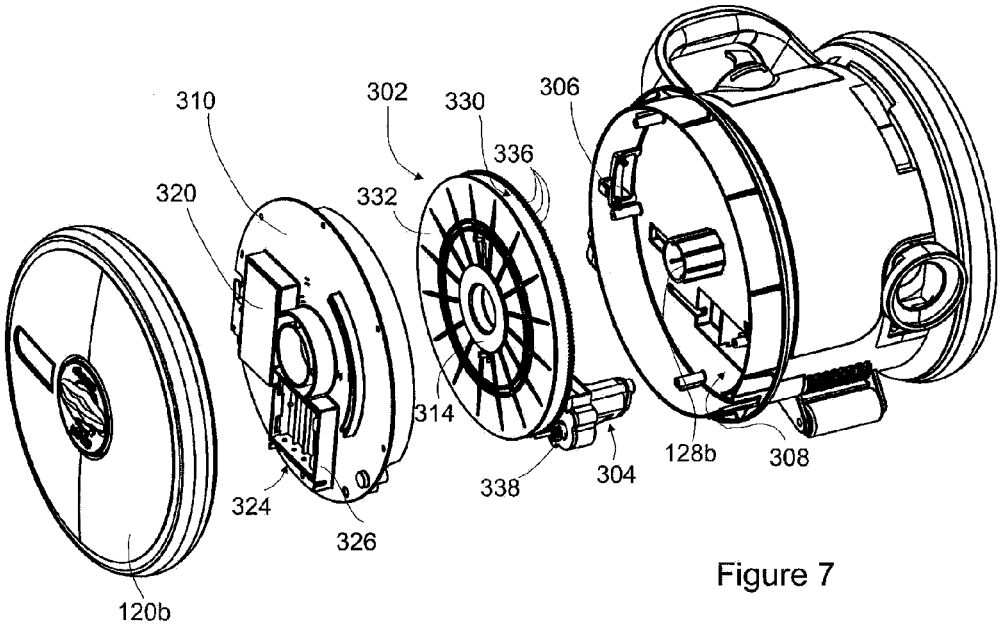
FIG. 7 is a partially exploded view of the surface cleaning apparatus of FIG. 1, with a side wheel, cover plate and cord wrap spool exploded.
Figure 7A:
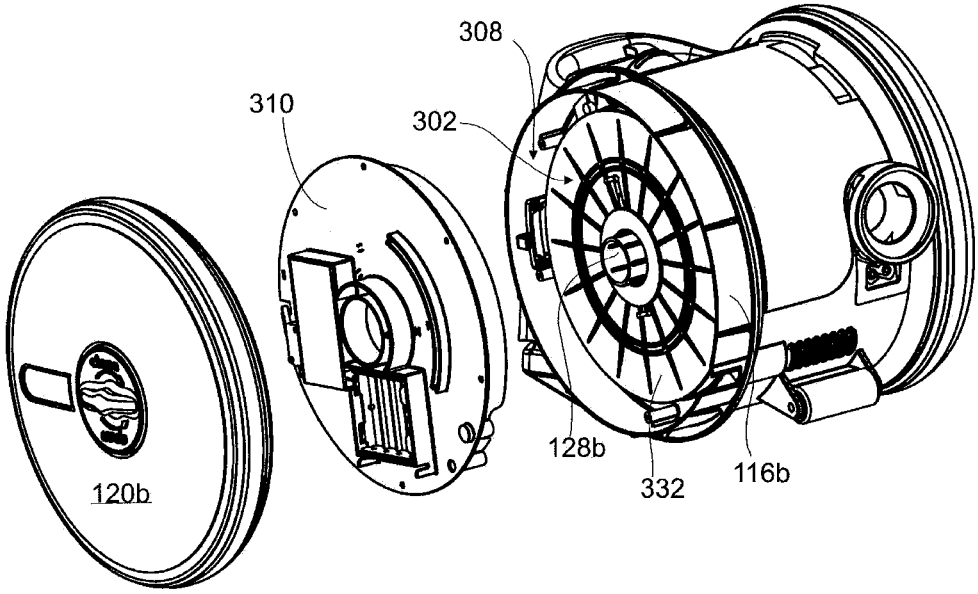
Figure 8:
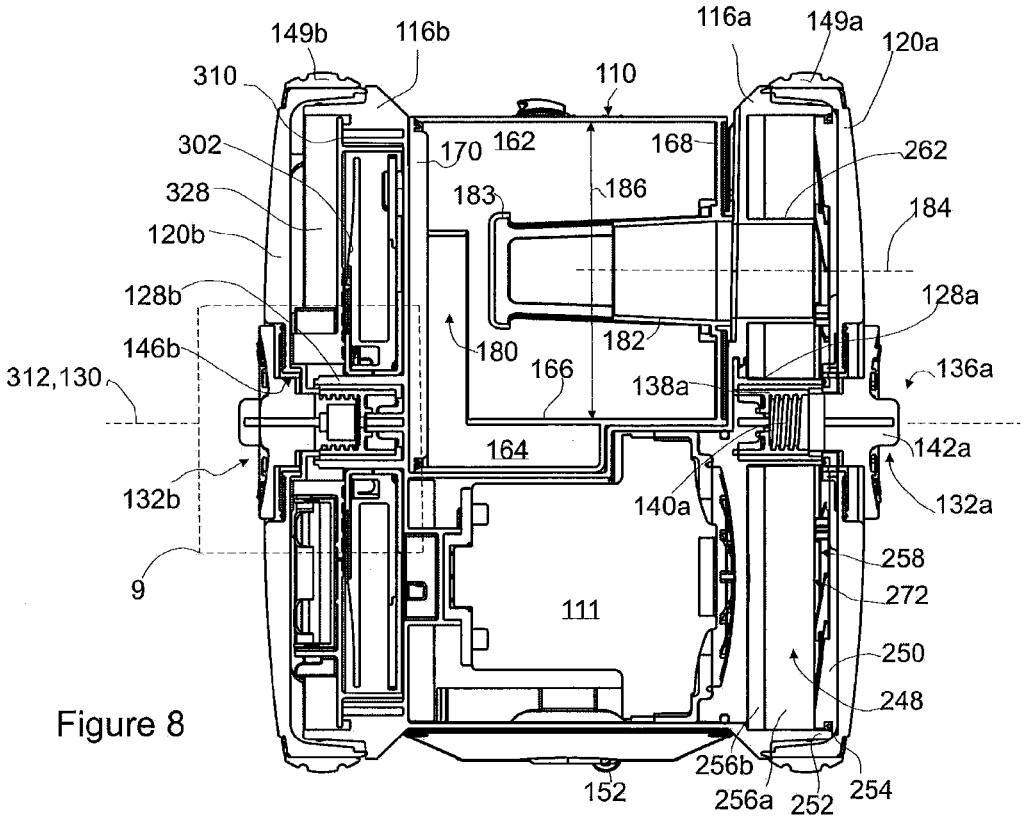
Figure 9:
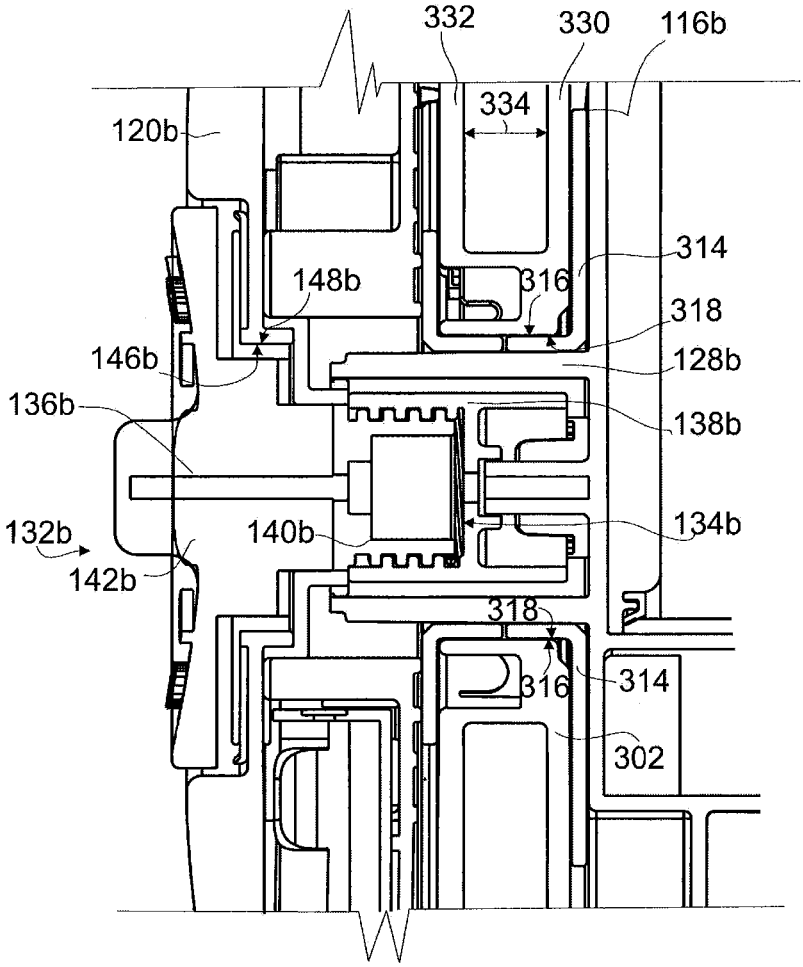
Figure 10:
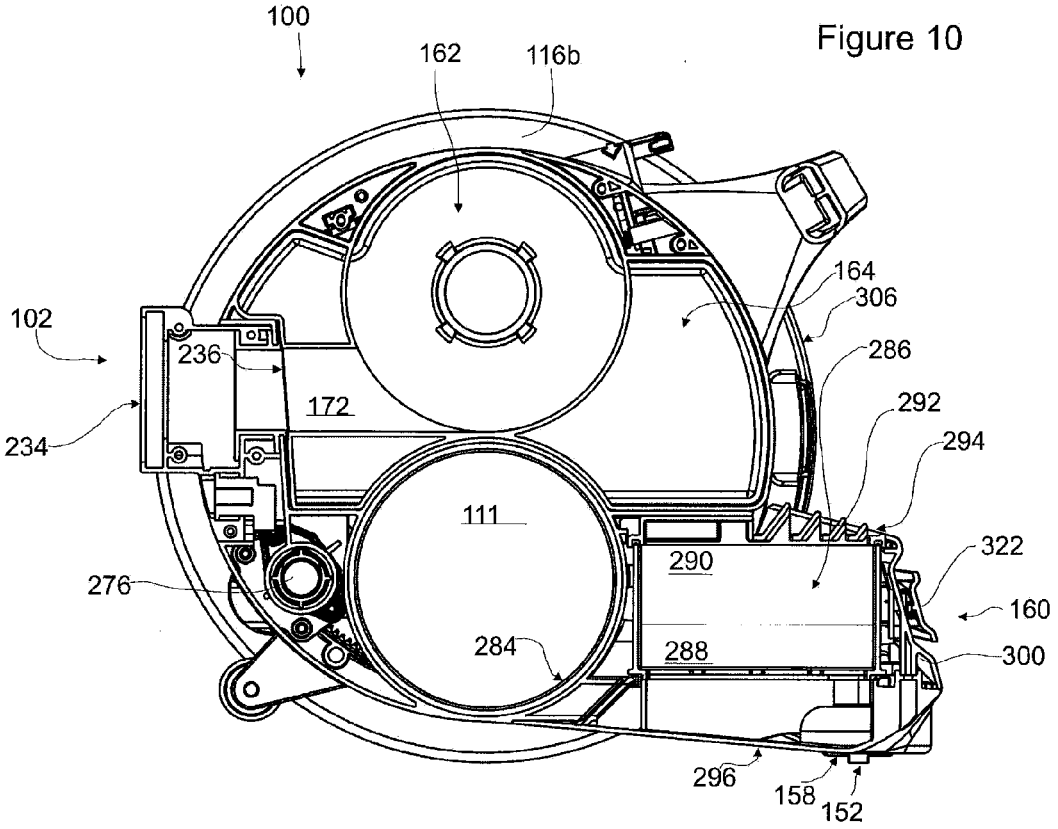
Figure 11:
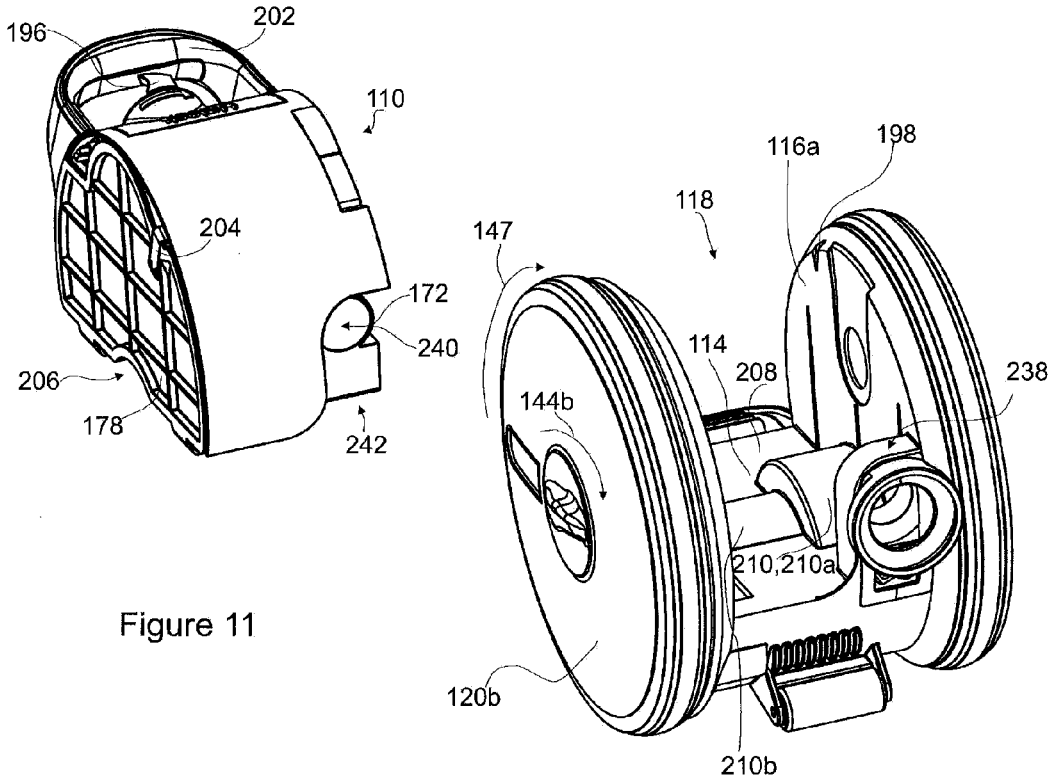
Figure 12:
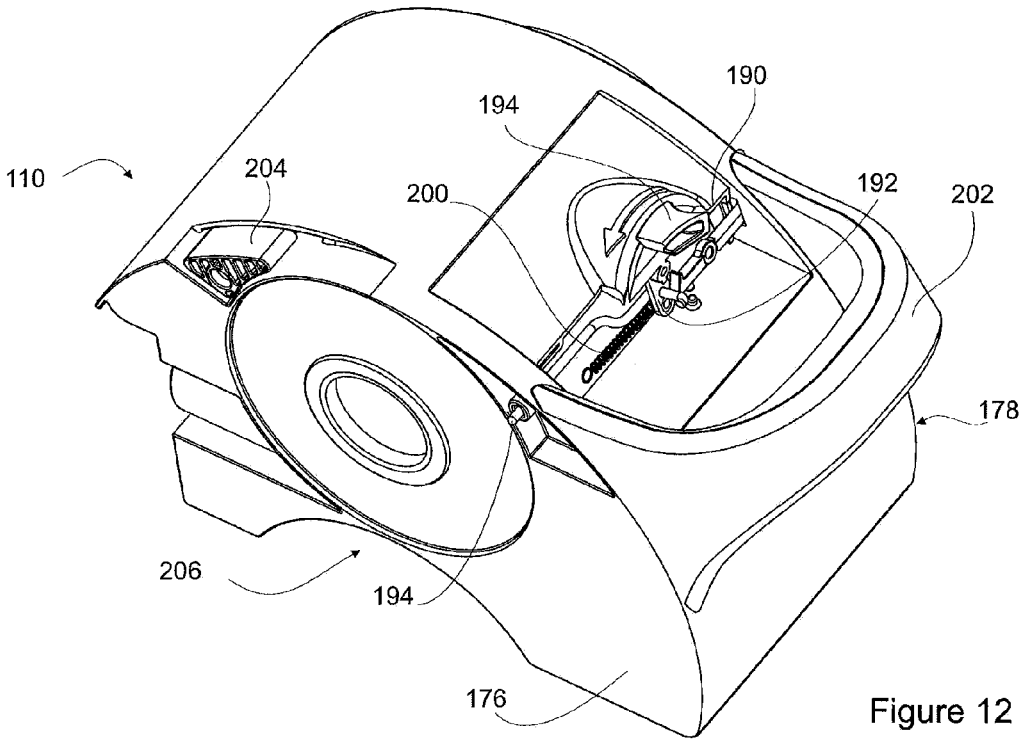
Figure 13:
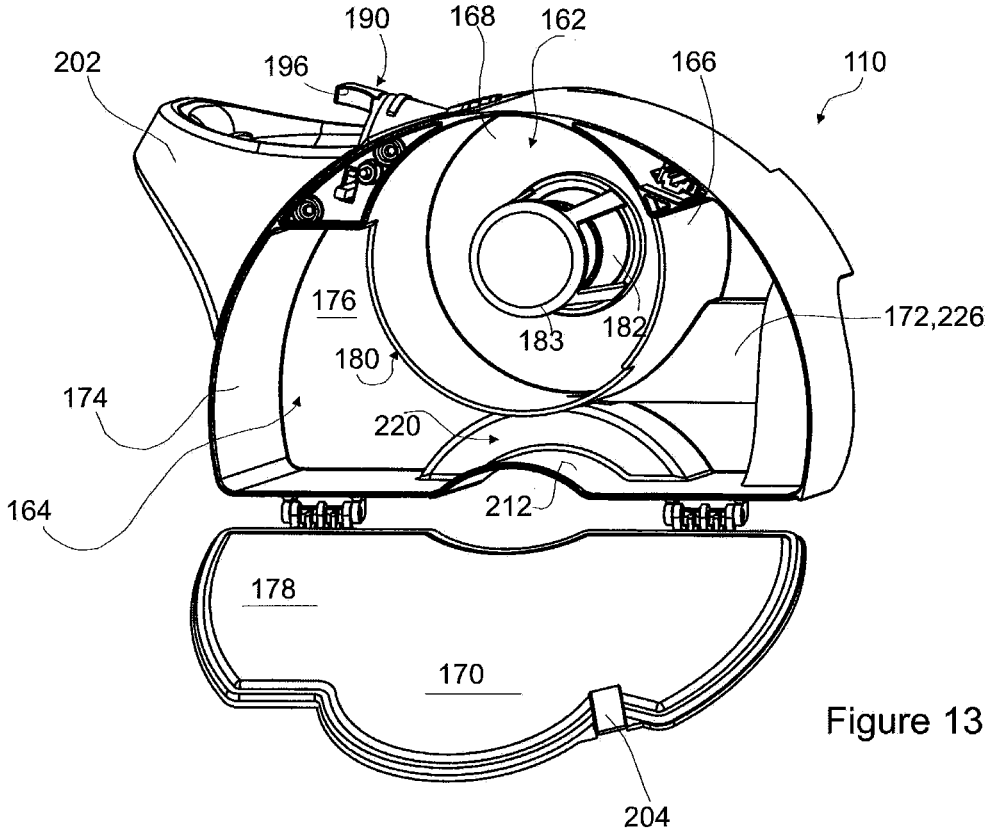
Figure 14:
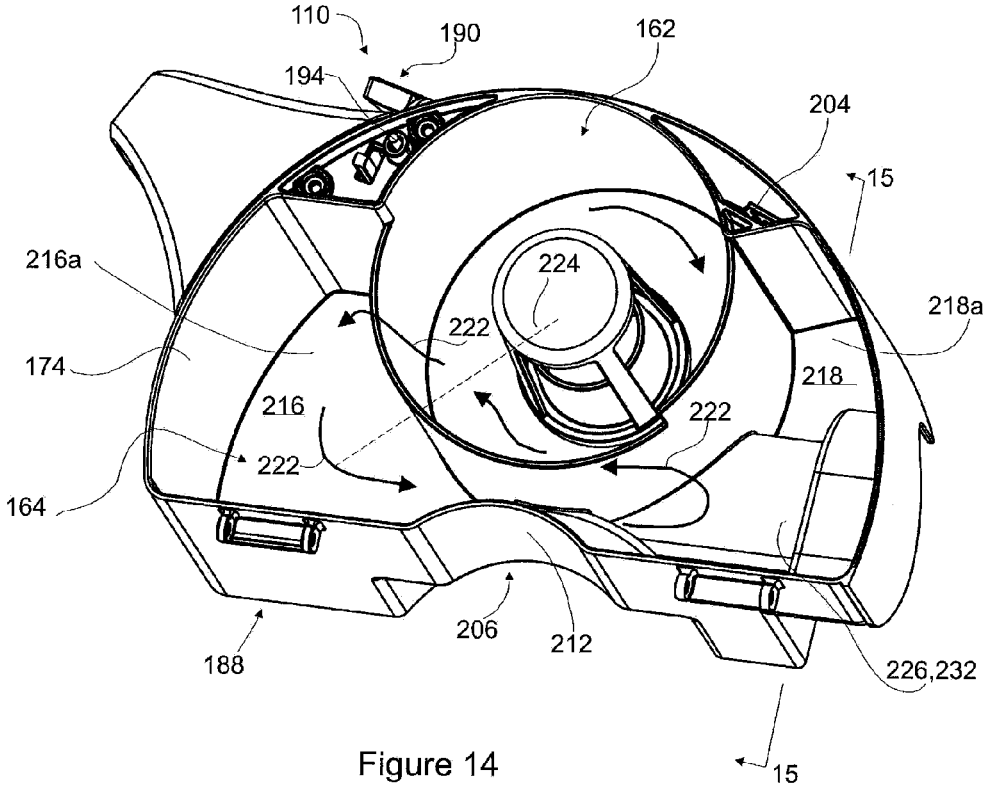
Figure 15:
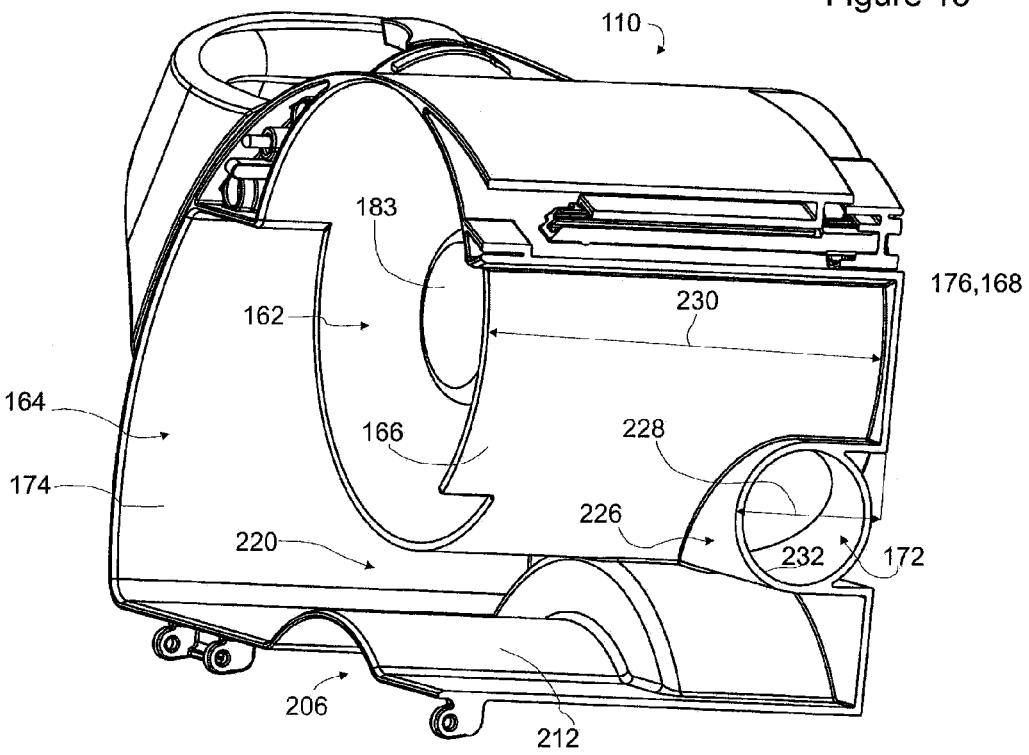

FIG. 7*a* is the partially exploded view of FIG. 7, with the cord wrap spool in the cord wrap chamber;

FIG. 8 is a section taken along line 8-8 in FIG. 1;

FIG. 9 is an enlarged view of a portion of FIG. 8;

FIG. 10 is a section taken along line 10-10 in FIG. 1;

FIG. 11 is a perspective view of the surface cleaning apparatus of FIG. 1, with a cyclone bin assembly removed;

FIG. 12 is a top perspective view of the cyclone bin assembly of FIG. 11;

FIG. 13 is perspective view of the cyclone bin assembly of FIG. 12, with one end wall open;

FIG. 14 is perspective view of the cyclone bin assembly of FIG. 13, with one end wall removed; and FIG. 15 is a section view taken along line 15-15 in FIG. 14.

DETAILED DESCRIPTION

Figure 2:
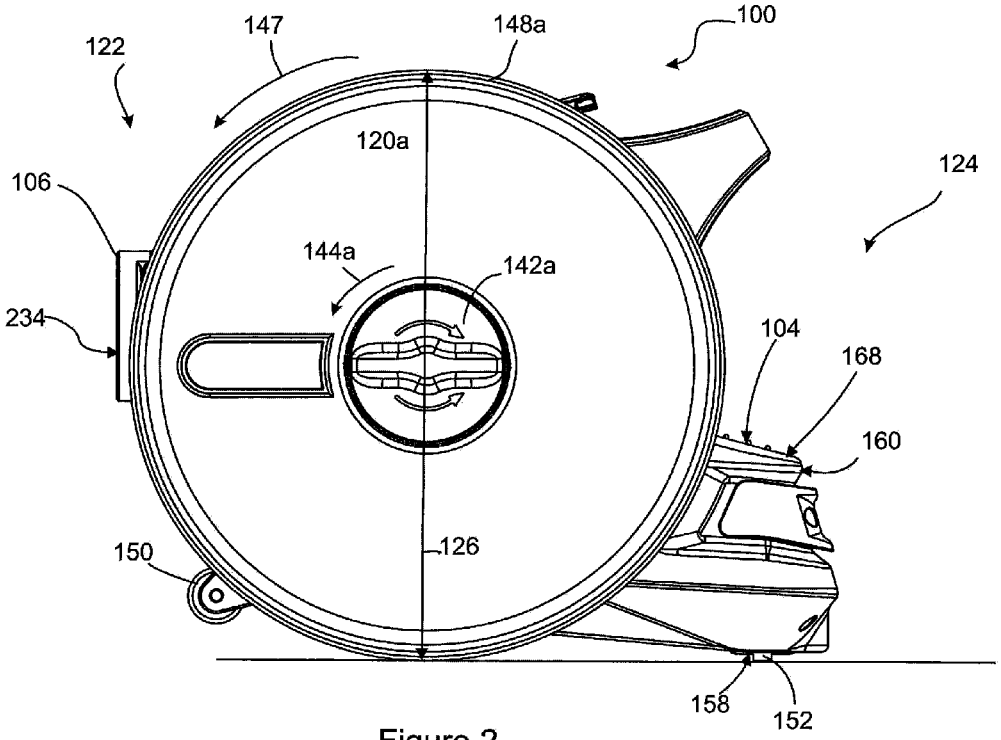
FIG. 2 is a left side elevation view of the surface cleaning apparatus of FIG. 1.
Figure 3:
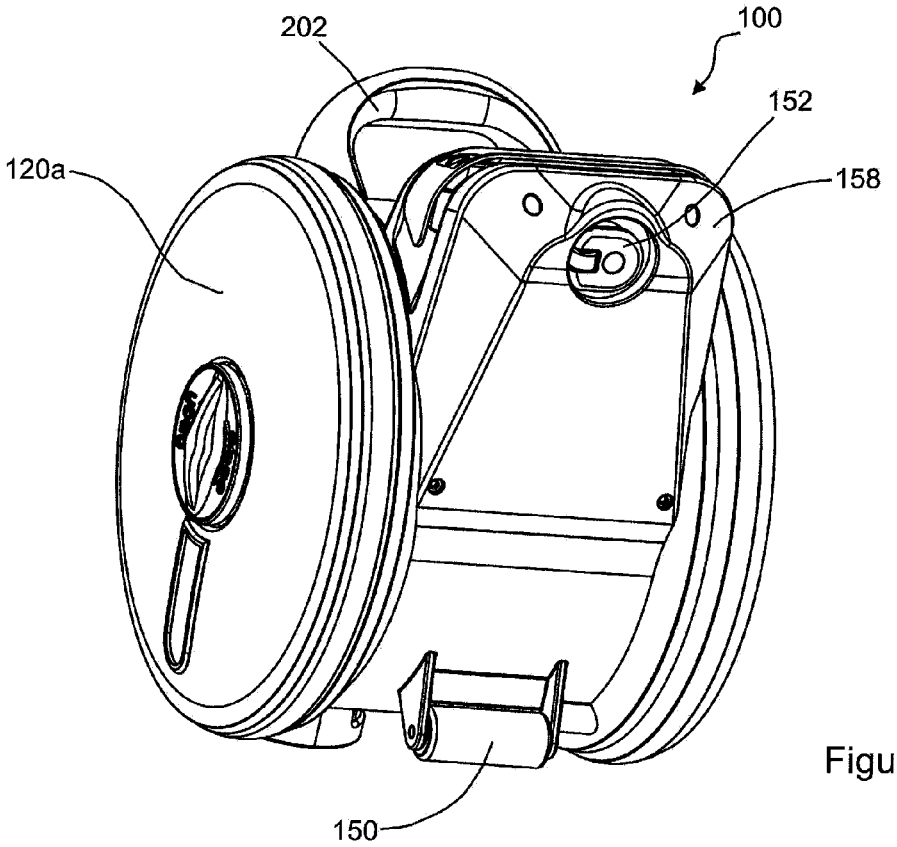
FIG. 3 is a rear lower perspective view of the surface cleaning apparatus of FIG. 1.

Referring to FIGS. 1 to 3, an embodiment of a surface cleaning apparatus 100 is shown. In the embodiment illustrated, the surface cleaning apparatus 100 is a canister vacuum cleaner.

General Overview

This detailed description discloses various features of surface cleaning apparatus 100. It will be appreciated that a particular embodiment may use one or more of these features. In appropriate embodiments, the surface cleaning apparatus 100 may be another type of surface cleaning apparatus, including, for example, a hand operable surface cleaning apparatus, an upright vacuum cleaner, a stick vac, a wet-dry vacuum cleaner and a carpet extractor.

Referring still to FIG. 1, the surface cleaning apparatus 100 has a dirty air inlet 102, a clean air outlet 104 and an airflow passage extending therebetween. In the embodiment shown, the dirty air inlet 102 is the air inlet 234 of an optional suction hose connector 106 that can be connected to the downstream end of a flexible suction hose or other type of cleaning accessory tool, including, for example, a surface cleaning head, a wand and a nozzle. Any standard surface cleaning head may be provided on the upstream end of the flexible hose or wand. In some embodiments, a hose connector may not be used. Alternately, or in addition, the hose or wand may be connected directly to treatment member 108.

From the dirty air inlet 102, the airflow passage extends through an air treatment member 108 that can treat the air in a desired manner, including for example removing dirt particles and debris from the air. Preferably, as shown in the illustrated example, the air treatment member 108 comprises a cyclone bin assembly 110. Alternatively, or in addition, the air treatment member 108 can comprise a bag, a filter or other air treating means. In some embodiments, the air treatment member may be removably mounted to main body 112 or may be fixed in main body 112. In some embodiments, the cyclone bin assembly may be of any design or it may use one or more features of the cyclone bin assembly disclosed herein.

A suction motor 111 (FIG. 8) is preferably mounted within a main body 112 of the surface cleaning apparatus 100 and is in fluid communication with the cyclone bin assembly 110.

As exemplified in FIG. 11, the body 112 of the surface cleaning apparatus 100 preferably is a rollable, canister-type body that comprises a platform 114 and two opposing sidewalls 116*a*, 116*b* that cooperate to define a central cavity 118. The surface cleaning apparatus 100 also preferably comprises two main side wheels 120*a*, 120*b*, rotatably coupled to the sidewalls 116*a* and 116*b*, respectively.

The clean air outlet 104, which is in fluid communication with an outlet of the suction motor 111, is preferably provided in the body 112. In the illustrated example, the dirty air inlet 102 is preferably located toward the front 122 of the surface cleaning apparatus 100, and the clear air outlet is preferably located toward the rear 124.

Rotation Mount for the Main Side Wheels

Preferably, as shown in the illustrated example, the body sidewalls 116*a,b* are generally circular and cover substantially the entire side faces of the surface cleaning apparatus 100. One main side wheel 120*a*, 120*b* is coupled to the outer face of each body sidewall 116*a* and 116*b*, respectively. Optionally, the side wheels 120*a*, 120*b* may have a larger diameter 126 than the body sidewalls 116*a,b* and can completely cover the outer faces of the sidewalls 116*a,b*. Each side wheel 120*a,b* is rotatably supported, e.g., by a corresponding axle mount 128*a*, 128*b*, which extends from the body sidewalls 116*a* and 116*b*, respectively. The main side wheels 120*a* (FIG. 6) and 120*b* (FIG. 7) are rotatable about a primary axis of rotation 130. In the illustrated example, the primary axis of rotation 130 passes through the cyclone bin assembly 110 (see for example FIG. 8).

Optionally, at least one of the side wheels 120*a,b* can be openable, and preferably detachable from the body 112. Referring to FIGS. 4-9, in the illustrated example both side wheels 120*a* and 120*b* are detachably coupled to their corresponding axle mounts 128*a* and 128*b* by axles comprising threaded hub assemblies 132*a* and 132*b*, respectively, and can be removed from the body 112. Removing the side wheels 120*a*, 120*b* from the body 112, or otherwise positioning them in an open configuration, may allow a user to access a variety of components located in compartments between the side wheels 120*a* and 120*b* and the corresponding sidewalls 116*a* and 116*b*, as explained in greater detail below.

For clarity, reference will now be made to FIG. 9, which is an enlarged view of hub assembly 132*b*, and it is understood that analogous features are provided on hub assembly 132*a* and can be referenced herein using the same references numbers having an "a" suffix. Hub assembly 132*b* provides a rotational mount for wheel 120*b* and may be of various designs.

As exemplified, hub assembly 132*b* comprises a threaded socket 134*b* and mating threaded lug 136*b*. The threaded inserts 138*b* provide a threaded central bores for receiving the mating threaded shafts 140*b* on the lugs 136*b*.

In the illustrated each threaded socket 134*b* comprises a threaded insert member 138*b*, that is positioned within a corresponding axle mount 128*b*, and preferably non-rotatably and non-removably mounted, in axle mount 128*b*. The threaded insert 138*b* may be non-rotatably fastened to the axle mount 128*b*, for example by using a screw or other fastener, a sliding locking fit, an adhesive and the like. Each lug 136*b* comprises a thread shaft 140*b* extending from a head 142*b*. The threaded shaft 140*b* has external threads for engaging the threaded bore of the threaded insert 138*b*.

Alternatively, instead of providing a separate thread insert member, the socket 134*b* can comprise integral threads formed on the inner surfaces of the axle mount 128*b*. Alternately the sidewalls may include a bearing or the like.

In the illustrated example, the heads 142*a*, 142*b* are configured to be engaged by a user. Each lug 136*a*, 136*b* is rotatable between a locked and an unlocked position relative to its insert 138*a*, 138*b*. In the unlocked position, the lugs 136*a*, 136*b* can be axially inserted and removed from the inserts 138*a*, 138*b*. Removing the lugs 136*a*, 136*b* from the inserts 138*a*, 138*b* can allow a user to remove the side wheels 120*a* and 120*b* retained by the lugs 136*a* and 136*b*, respectively. To re-attach the side wheels 120*a*, 120*b*, a user can position the side wheel 120*a*, 120*b* over the corresponding sidewall 116*a*, 116*b*, insert the lugs 136*a*, 136*b* into the treaded inserts 138*a*, 138*b* and then rotate the lugs 136*a*, 136*b*, in a locking direction 144*a* (FIG. 2), 144*b* (FIG. 11), into the locked position to retain the wheels 120*a*, 120*b* in their operating position.

In the illustrated example, the heads 142*a* and 142*b* are sized and shaped to be grasped by the bare fingers of a user. Configuring the heads 142*a*, 142*b* to be grasped by the bare fingers of a user may help facilitate the attachment and release of the lugs 136*a*, 136*b* from the threaded inserts 138*a*, 138*b* by hand, without requiring additional tools. Alternatively, or in addition to be graspable by bare fingers, the heads 136*a*, 136*b* can be configured to be engaged by a tool, including, for example, a screw driver, socket, allan key and wrench. When assembled in the manner shown in FIG. 8, both the lugs 136*a*, 136*b* and threaded inserts 138*a*, 138*b* remain fixed and do not rotate relative to the body 112 when the surface cleaning apparatus 100 is in use.

Referring again to FIG. 9, lug 136*b* comprises a wheel bearing surface 146*b* configured to rotatably support an inner edge 148*b* of a corresponding the side wheel 116*b*. Allowing rotation between the wheel bearing surface 146*b* and the inner edge 148*b* of the wheel 120*b* facilitates rotation of the side wheel 120*b* relative to the body 112. Optionally, the interface between the wheel bearing surface 146*b* and the inner edge 148*b* of the side wheel 120*b* can be lubricated or otherwise treated to help reduce friction at the interface may be provided. In some examples, a rotary bearing or other type of bearing apparatus may be used to support the side wheels 120*a* and 120*b* on the hub assemblies 132*a* and 132*b*. In the illustrated example, the wheel bearing surfaces 146 on the lug portions 132*a*, 132*b* are identical, and the inner edges 148 of the side wheels 120*a*, 120*b* are identical. Providing identical wheel bearing surfaces 146*a*,146*b* and inner edge surfaces 148*a*, 148*b* may allows the side wheels 120*a*, 120*b* to be interchangeable, such that each side wheel 120*a*, 120*b* can be used on either side of the surface cleaning apparatus 100.

Preferably, the friction between the wheel bearing surface 146*b* and the inner edge 148*b* of the side wheel 120*b* is sufficiently low to allow the side wheel 120*b* to rotate relative to the lug 136*b* without exerting a significant rotation torque on the lug 132*b*. However, in some circumstances, the side wheels 120*a*, 120*b* may exert a rotational torque on the lugs 136*a*, 136*b*. Optionally, the threads on the lugs 136*a*, 136*b* and inserts 138*a*, 138*b* can be configured so that the direction of forward rotation 147 of a side wheel, for example side wheel 120*a* in FIG. 2, coincides with the locking direction 144*a* of the corresponding lug, for example lug 138*a*. In this configuration, the locking direction 144*a* of the lug 136*a* can be opposite the locking direction 144*b* of lug 136*b*. Providing lugs 136*a*, 136*b* with threads configured to having opposing locking directions 144*a*, 144*b* can enable each lug 136*a*, 136*b* to have a locking direction 144*a*, 144*b* that coincides with, e.g., the forward direction of rotation of the side wheel 120*a*, 120*b*. Preferably, as shown in the illustrated example, the locking direction of lug 144*a* is counter-clockwise (as viewed in FIG. 2), and the locking direction of lug 144*b* is clockwise (as viewed in FIG. 11).

In this configuration, when the surface cleaning apparatus 100 is being pulled in a forward direction, rotational torque exerted by the side wheels 120*a*, 120*b* on the lugs 136*a*, 136*b* may drive the lugs 136*a*, 136*b* toward their locked positions. This may help reduce the chances of a lug 136*a*, 136*b* becoming unintentionally loosened or unscrewed by the rotation of the side wheels 120*a*, 120*b*.

Figure 4:
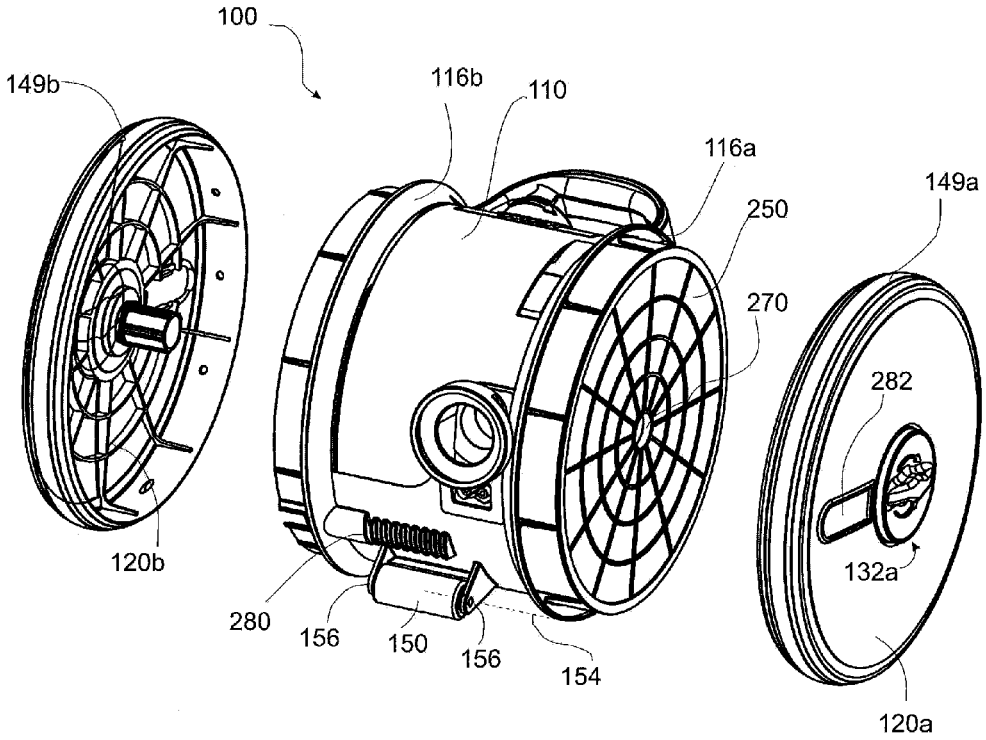
FIG. 4 is a partially exploded view of the surface cleaning apparatus of FIG. 1, with the side wheels exploded.

Referring to FIGS. 4 and 8, optionally, each wheel 120*a*, 120*b* may comprise a tire 149*a*, 149*b* extending around the perimeter of the wheel. The tires 149*a*, 149*b* can be formed from a different material than the wheels 120*a*, 120*b*. Optionally, the tire 149*a*, 149*b* can be formed from a material that is softer than the wheel material, for example rubber, which may help increase the traction of the wheels 120*a*, 120*b*.

Preferably, the main side wheels 120*a*, 120*b* are configured to carry a majority of the load of the surface cleaning apparatus 100, when the surface cleaning apparatus 100 is in use. In the example illustrated, the surface cleaning apparatus 100 may ride solely or primarily on the side wheels 120*a*, 120*b* when it is being pulled in a forward or backward direction by a user.

Stabilizer Wheels

Optionally, the surface cleaning apparatus 100 can comprise one or more stabilizer wheels, in addition to the side wheels 120*a*, 120*b*. Preferably, the stabilizer wheels are configured to help support the surface cleaning apparatus 100 in a generally horizontal position as exemplified in FIG. 2 when the surface cleaning apparatus 100 is at rest. Optionally, the stabilizer wheels can be configured to not contact the ground when the body 112 is horizontal, and contact the ground when the body 112 rotates forward, or backward, by a predetermined amount. Configuring the stabilizer wheels in this manner may help prevent the surface cleaning apparatus 100 from over-rotating in a forward or backward direction. Preferably, if front and rear stabilizer wheels are provided, then the stabilizer wheels are positioned such that only one will contact a horizontal floor surface at a time.

Referring to FIGS. 1-4, in the illustrated example, the surface cleaning apparatus 100 comprises a front stabilizer wheel 150 and a rear stabilizer wheel 152. The front stabilizer wheel is preferably a cylindrical, roller-type wheel mounted toward the front of the body 112 by a pair of mounting brackets 156. The front stabilizer wheel is rotatable about an axis 154 of rotation that is generally parallel to the primary axis of rotation 130 and is provided forward of the primary axis of rotation 130. Optionally, the front stabilizer wheel 150 can be located so that the axis of rotation 154 is outside the diameter 126 of the side wheels 120*a*, 120*b*.

When the surface cleaning apparatus 100 is in a horizontal configuration, for example when it is in use, the front stabilizer wheel 150 may be spaced above the floor (see FIG. 2). When the surface cleaning apparatus 100 pivots forward, the front stabilizer wheel 150 can contact the ground. With the front stabilizer wheel 150 on the ground, the surface cleaning apparatus 100 is supported in a generally stable rest position by three points of contact (the side wheels 120*a*, 120*b* and the front stabilizer wheel 150).

Preferably, as shown in the example illustrated, the rear stabilizer wheel 152 is a swivelable, caster-type wheel. The rear stabilizer wheel 152 may be swivelably mounted in a recess 158 on the underside of a post-motor filter housing 160 (see also FIG. 10), which extends from the rear of the body 112. The rear stabilizer wheel 152 is preferably mounted behind the primary axis of rotation 130. In the illustrated example, the rear stabilizer wheel 152 can be in rolling contact with the ground when the surface cleaning apparatus 100 is in the horizontal position. In this configuration, the rear stabilizer wheel 152 can help support the surface cleaning apparatus 100 when it is in use, and may help limit rearward rotation of the body 112.

Optionally, the front and rear stabilizer wheels 150, 152 can be configured so that only one of the stabilizer wheels 150, 152 can contact the ground at any given time when the vacuum cleaner is on a horizontal surface. This prevents both stabilizer wheels 150, 152 from simultaneously contacting the ground when the vacuum cleaner is used on a horizontal surface. If both stabilizer wheels contact the ground at the same time, this may interfere with the steering of the surface cleaning apparatus 100. In the example illustrated, the rear stabilizer wheel 152 is lifted out of contact with the ground when the front stabilizer wheel 150 is in contact with the ground, and vice versa.

Cyclone Bin Assembly

Referring to FIGS. 8, 10, 11, 13 and 14, in the illustrated example, cyclone bin assembly 110 includes a cyclone chamber 162 and a dirt collection chamber 164. The cyclone bin assembly 110 is detachably mounted in the cavity 118, laterally between the sidewalls 116*a*, 116*b* and side wheels 120*a*, 120*b*. Positioning the cyclone bin assembly 110 in the cavity 118, between the body sidewalls 116*a*, 116*b* may help protect the cyclone bin assembly 110 from side impacts, for example if the surface cleaning apparatus 100 contacts a piece of furniture or other obstacle. Preferably, the body sidewalls 116*a*, 116*b* have a larger cross-sectional area than the cyclone bin assembly 110. More preferably, the transverse faces of the cyclone bin assembly 110 are entirely covered by the body sidewalls 116*a*, 116*b*.

In the illustrated example, the cyclone chamber 162 is bounded by a sidewall 166, a first end wall 168 and a second end wall 170. A tangential air inlet 172 is provided in the sidewall of the cyclone chamber 162 and is in fluid communication with the dirty air inlet 102. Air flowing into the cyclone chamber 162 via the air inlet can circulate around the interior of the cyclone chamber 162 and dirt particles and other debris can become disentrained from the circulating air.

A slot 180 formed between the sidewall 166 and the second end wall 170 serves as a cyclone dirt outlet 180 (FIG. 8). Debris separated from the air flow in the cyclone chamber 162 can travel from the cyclone chamber 162, through the dirt outlet 180 to the dirt collection chamber 164.

Air can exit the cyclone chamber 162 via an air outlet. In the illustrated example, the cyclone air outlet includes a vortex finder 182 (FIGS. 8, 13). Optionally, a removable screen 183 can be positioned over the vortex finder 182. The cyclone chamber 162 extends along a longitudinal cyclone axis 184. In the example illustrated, the longitudinal cyclone axis is aligned with the orientation of the vortex finder 182 and is generally transverse to the direction of movement of the surface cleaning apparatus 100. The cyclone chamber 162 has a generally circular cross sectional shape (taken in a plane perpendicular to the cyclone axis) and has a cyclone diameter 186.

The dirt collection chamber 164 comprises a sidewall 174, a first end wall 176 and an opposing second end wall 178. Preferably, as shown in the illustrated example, at least a portion of the dirt collection chamber sidewall 174 is integral with a portion of the cyclone chamber sidewall 166, and at least a portion of the first cyclone end wall 168 is integral with a portion of the first dirt collection chamber end wall 176.

A lower surface 188 of the cyclone bin assembly 110 is preferably configured to rest on the platform 114, and the first and second end walls 168, 170 of the cyclone bin assembly 110 may be shaped to engage the inner surfaces of the body sidewalls 116*a*, 116*b*, respectively. The upper portion of the cyclone bin assembly 110 (as viewed when installed in the cavity 118) can have a radius of curvature that generally corresponds to the radius of curvature of the body sidewalls 116*a*, 116*b* and the side wheels 120*a*, 120*b*. Matching the curvature of the cyclone bin assembly 110 with the curvature of the side wheels 120*a*, 120*b* may help facilitate mounting of the cyclone bin assembly 110 within the body 112, so that the walls of the cyclone bin assembly 110 do not extend radially beyond the body sidewalls 116*a*, 116*b* or main side wheels 120*a*, 120*b*.

Referring to FIG. 13, the second dirt collection chamber end wall 178 is preferably pivotally connected to the dirt collection chamber sidewall 174. The second dirt collection chamber end wall 178 can be opened to empty dirt and debris from the interior of the dirt collection chamber 164. Optionally, the cyclone chamber is openable concurrently with the dirt collection chamber. Accordingly, for example, the second cyclone end wall 170 is integral with and is openable with the second dirt collection chamber end wall 178. Opening the second cyclone end wall 170 can allow dirt and debris to be emptied from the cyclone chamber 162. The second dirt collection chamber sidewall 178 can be retained in the closed position by a releasable latch 204.

Optionally, the screen 183 and/or the vortex finder 182 can be removable from the cyclone chamber 162 and can be removed when the second dirt collection chamber end wall 178 is open.

Cyclone Assembly Bin Lock

Referring to FIGS. 11-14, a releasable bin locking mechanism 190 can be used to secure the cyclone bin assembly 110 within the cavity 118. Preferably, the bin locking mechanism 190 retains the cyclone bin assembly 110 within the cavity 118 by engaging at least one of the body sidewalls 116*a*, 116*b*, although the cyclone bin assembly may alternately, or in addition, be secured to the platform 114.

In the illustrated example, the bin locking mechanism 190 comprises a mechanical linkage comprising an actuating lever 192 pivotally connected to the cyclone bin assembly 110 and a pair of locking pins 194 movably connected to the actuating lever 192. A release member 196, that is configured to be engaged by a user, is connected to the actuating lever 192. Corresponding locking cavities 198 for engaging the locking pins 194 are provided in the body sidewalls 116*a*, 116*b*. In the illustrated example, the locking cavities 198 are shaped to slidingly receive the locking pins 194. Pivoting the actuating lever 192 causes the locking pins 194 to move between a locked position, in which the locking pins 194 extend into the locking cavities 198, and a retracted position in which the locking pins 194 are free from the locking cavities 198. Optionally, the bin locking mechanism 190 can include a biasing member, for example spring 200, for biasing the actuating lever 192 and locking pins 194 toward the locked position. It will be appreciated that a single locking pin 194 may be used. Also, other locking mechanisms may be utilized.

A handle 202 is provided on the top of the cyclone bin assembly 110. The handle 202 is configured to be grasped by a user. When the cyclone bin assembly 110 is mounted on the body 112, the handle 202 can be used to manipulate the surface cleaning apparatus 100. When the cyclone bin assembly 110 is removed from the body 112, the handle 202 can be used to carry the cyclone bin assembly 110, for example to position the cyclone bin assembly 110 above a waste receptacle for emptying. In the illustrated example, the handle 202 is connected to the dirt collection chamber sidewall 174.

Preferably, the handle 202 is in close proximity to the release member 196 of the bin locking mechanism 190. Placing the handle 202 and release member 196 in close proximity may allow a user to release the bin locking mechanism 190 and lift the cyclone bin assembly 110 out of the cavity 118 with a single hand. Accordingly, the actuator (e.g., release member 196) for the locking mechanism may be located such that the actuator may be operated simultaneously when a user grasps handle 202, thereby permitting one handed operation of the bin removal.

Configuration of the Dirt Collection Chamber

Referring to FIGS. 11-14, the dirt collection chamber sidewall 174 comprises a recess 206 that is shaped to receive a corresponding portion of the body 112. In the illustrated example, the platform 114 comprises a generally planar bearing surface 208 for supporting the cyclone bin assembly 110. The platform 114 also comprises at least a portion of the suction motor housing 210 surrounding the suction motor 111. In this example, the recess 206 in the dirt collection chamber sidewall 174 is shaped to receive the portion of the motor housing 210 projecting above the planar bearing surface 208.

Preferably, at least a portion of the dirt collection chamber 164 surrounds at least a portion of the suction motor 111 and the suction motor housing 210. In this example, at least a portion of the dirt collection chamber 164 is positioned between the cyclone chamber 162 and the suction motor housing 210 (and the suction motor 111 therein). The shape of the recess 206 is selected to correspond to the shape of the suction motor housing 210. Preferably, the suction motor housing is shaped to conform with the shape of the suction motor. Accordingly, suction motor housing may have a first portion 210*a* that overlies the suction fan and a second portion 210*b* that overlies the motor section. Configuring the dirt collection chamber 164 to at least partially surround the suction motor housing 210 may help reduce the overall size of the surface cleaning apparatus 100, and/or may help increase the capacity of the dirt collection chamber 164. Alternately, or in addition, the dirt collection chamber 164 may surround at least a portion of the cyclone chamber 162.

Diverter Wall

Optionally, the dirt collection chamber 164 can include one or more internal diverter walls. The diverter walls may help separate the dirt collection chamber 164 into separate dirt collection portions. Preferably, the diverter wall can be positioned opposite the dirt outlet 180 of the cyclone chamber 162. Providing the diverter wall opposite the dirt outlet 180 may help divide the incoming dirt particles and other debris between the first and second dirt collection portions.

In the illustrated example, the dirt collection chamber 164 includes a diverter wall 212 that is positioned opposite the dirt outlet 180 and may extend along substantially the entire height 230 (FIG. 15) of the cyclone chamber 162. As exemplified in FIG. 15, diverter all 212 may comprise the portion of the recess that seats on the second portion 210*b* of motor housing 210 that overlies the motor section.

In this example, the diverter wall 212 is a curved portion of the dirt collection chamber sidewall 174, which comprises the inner surface of the recess 206 described above. In other embodiments, the diverter wall 212 can be a separate member or rib extending from the dirt collection chamber sidewall 174. Alternatively, the diverter wall 212 can be shorter than the cyclone chamber 162. Preferably, the diverter wall 212 overlies at least a portion of the dirt outlet 180. In other embodiments, diverter wall 212 may extend all the way to end wall 176 or may terminate prior thereto and preferably at a location spaced from dirt outlet 180 towards end wall 176.

The diverter wall 212 defines a first dirt collection portion 216 on a first side of the diverter wall 212, and a second dirt collection 218 portion on an opposing second side of the diverter wall 212. In the illustrated example the diverter wall 212 does not extend all the way to cyclone sidewall 166 and the first and second dirt collection portions 216, 218 are not isolated from each other. In this configuration, a relatively narrow throttling passage 220 is defined between the diverter wall 212 and the cyclone sidewall 166.

In use, dirty air from the cyclone chamber 162 can exit the dirt outlet 180 and flow into the dirt collection chamber 164, as illustrated using arrows 222. The dirty air flowing through the dirt collection chamber 164 can carry entrained fine dirt particles, and other debris. The passage 220 is configured to allow dirty air, containing dirt particles and other debris to move between the first and second dirt collection portions 216, 218.

Preferably, the dirt outlet 180 is asymmetrically positioned relative to the first and second dirt collection portions 216, 218. That is, the dirt outlet 180 is configured so that the centre of the dirt outlet 180, represented by radially oriented axis 224, is located within dirt collection portion 216. In this configuration, the centre of the dirt outlet 180 is not aligned with the diverter wall 212. Configuring the dirt outlet 180 in this manner may help direct dirty air exiting the dirt outlet 180 toward dirt collection portion 216. Alternatively, the dirt outlet 180 can be configured so that is symmetrically positioned relative to the dirt collection portions 216, 218.

In operation, preferably, the air exits the dirt air outlet 180 and enters first portion 216. The air travels to or towards the distal part 216*a* and then turns to return through first part 216 towards passage 220. Some of the entrained dirt will be disentrained as the air changes direction in part 216. Passage 220 is preferably narrower than the portion of the dirt chamber upstream thereof. Accordingly, this will cause an increase in the velocity of the air travelling through passage 220 to second portion 218. In particular, as the dirty air moves from the relatively large volume of dirt collection portion 216 to the relatively narrow passage 220, the velocity of the air, and the fine particles entrained therein, may increase. The air travels to or towards the distal part 218*a* and then turns to return through dirt outlet 180 into the cyclone chamber. Some of the entrained dirt will be disentrained as the air changes direction in part 218. Further, when the dirty air flow exits the passage 220 and enters the relatively larger volume of dirt collection portion 218, the velocity of the dirty air may decrease, which may help disentrain the fine dirt particles traveling with the dirty air flow. Accordingly, passage 220 may be used to increase the velocity of the air stream and permit finer dirt to be deposited in second portion 218. Passing over by the divider wall 212 may also create eddy currents or other types of air flow disruptions, which may also help facilitate fine particle disentrainment. From dirt collection portion 218, the air can re-enter the cyclone chamber 162 through the dirt outlet 180 and exit via the vortex finder 182.

Optionally, instead of having a curved, convex shape, the diverter wall 212 can have another cross-sectional shape including, for example an angled or triangular cross-section and a rectangular cross-section. Any shape which reduces the width of passage 220 may be used (i.e., a portion of the wall facing the dirt outlet extends inwardly towards the dirt outlet 180).

Secondary Divider

Optionally, the dirt collection chamber 164 can comprise a secondary divider in a dirt collection portion. In the example illustrated, the secondary divider comprises a secondary divider ridge 226 extending inwardly from the end wall opposite the dirt outlet 180. In the example illustrated, the secondary divider ridge 226 extends from the second end wall 178 and preferably terminates prior to the first end wall 176, which also comprises the clean air outlet of the cyclone chamber 162. The secondary divider ridge 226 extends from the cyclone chamber sidewall 174 to the dirt collection chamber sidewall 166.

Providing a secondary divider ridge 226 in the dirt collection portion 218 may help direct air flow toward the dirt outlet 180, as illustrated by arrows 222. The secondary divider ridge 226 may also help create additional eddy currents and/or other flow disruptions that may help facilitate the disentrainment of fine dirt particles from the air flow 222. Directing the air flow toward the dirt outlet 180 may help create a relatively calm region, having relatively low air flow velocity, downstream from the secondary divider ridge 226 towards second end wall 176, in which fine dirt particles can accumulate. Providing a relatively calm region may help reduce re-entrainment of the fine particles that settle in the calm region into the air flow re-entering the dirt outlet 180. Accordingly, divider wall 226 may create a wind shield thereby inhibiting the reentrainment of fine dirt that has settled in second portion 218.

Referring to FIG. 15, the height 228 of the secondary diverting ridge (the distance it extends inwardly from lower surface 188) can be between about 5% and about 95% of the height 230 of the cyclone chamber 162. Preferably, the height 228 of the secondary diverting ridge 226 is less than about 66% of the height of the cyclone 230, and more preferably is approximately 30% of the cyclone height 230. Preferably, the secondary dividing ridge 226 does not extend into the dirt outlet 180.

In the example illustrated, the secondary diverting ridge 226 comprises a portion of sidewall 232 of the tangential air inlet 172. Alternatively, the secondary diverting ridge 226 can be a separate member extending from the second end wall 178, and need not comprise the tangential air inlet 172. While illustrated as having a curved, convex cross-sectional shape, the secondary diverting ridge 226 can have any other suitable cross-sectional shape, including, for example a triangular cross-section and a rectangular cross-section.

While the example illustrated is a horizontal or transverse cyclone configuration, the diverter wall 212, secondary dividing ridge 226 and dirt outlet 180 alignment features described above can also be used, individually or in combination, in a vertically oriented cyclone bin assembly 110.

Suction Hose Connector

Referring to FIGS. 10 and 11, in the illustrated example, the suction hose connector 106 is connected to the body 112, and remains connected to the body 112 when the cyclone bin assembly 110 is removed. The suction hose connector 106 comprises an air inlet 234 that is connectable to the suction hose, and an opposing air outlet 236. A throat portion 238 of the suction hose connector 106 extends between the air inlet 234 and air outlet 236. Coupling the suction hose connector 106 to the body 112 may help facilitate the removal of the cyclone bin assembly 110 (for example to empty the dirt collection chamber 164) while leaving a suction hose connected to the body 112, via the suction hose connector 106.

The air outlet 236 is configured to connect to the tangential air inlet 172 of the cyclone chamber 162. In the illustrated example, a sealing face 240 on the tangential air inlet 172 is shaped to match the shape of the air outlet 236 of the suction hose connector 106. Optionally, a gasket, or other type of sealing member, can be provided at the interface between the sealing face 240 and the air outlet 236.

The air outlet 236 of the suction hose connector 106 and the sealing face 240 of the tangential air inlet 172 are configured so that the sealing face 240 can slide relative to the air outlet 236 (vertically in the illustrated example) as the cyclone bin assembly 110 is being placed on, or lifted off of the platform 114. Lowering the cyclone bin assembly 110 onto the platform 114 can slide the sealing face 240 into a sealing position relative to the air outlet 236.

Preferably, as exemplified, the sealing face 240 (and preferably part or all of the hose connector) is recessed within the cyclone bin assembly 110. In the illustrated example, the cyclone bin assembly 110 includes a notch 242 configured to receive the throat portion of the suction hose connector 106 when the cyclone bin assembly 110 is placed on the platform. With the cyclone bin assembly 110 on the platform, at least a portion of the throat 238 and the air outlet 236 are nested within cyclone bin assembly 110. Nesting at least a portion of the suction hose connector 106 within the cyclone bin assembly 110 may also help reduce the overall length of the surface cleaning apparatus 100.

Optionally, the suction hose connector 106 can serve as an alignment member to help guide the cyclone bin assembly 110 into a desired orientation when bin assembly 110 is remounted on platform 114. Alternatively, in other embodiments the suction hose connector 106 may be fixedly connected to the cyclone bin assembly 110, and may be removable with the cyclone bin assembly 110.

Referring to FIG. 1, an electrical power connector 244 is provided adjacent the suction hose connector 106. The electrical power connector 244 can be configured to receive a mating power coupling and may provide power to a cleaning tool, including, for example a surface cleaning head with a powered rotating brush.

Filter Chamber, Seal Plate and Foam Structure

Referring again to FIGS. 4, 5, 6 and 8, air exiting the cyclone chamber 162 flows to a suction motor inlet 246 via a filter chamber 248. The filter chamber 248 is provided downstream from the cyclone air outlet. In the illustrated example, the filter chamber 248 comprises a recessed chamber in the body sidewall 116*a* that is enclosed by an seal plate 250, that is preferably openable. A sealing gasket 254 or other means of creating an air tight compartment, is preferably provided at the interface between an annular rim 252 of the sidewall 116*a* and the seal plate 250 to help provide an air-tight filter chamber 248. Preferably, as illustrated, the filter chamber 248 extends over substantially the entire sidewall 116*a* and overlies substantially all of the transverse cross sectional area of cyclone chamber 162, dirt collection chamber 164 and suction motor 111.

A pre-motor filter 256 is provided in the filter chamber 248 to filter the air before it enters the suction motor inlet. Preferably, as illustrated, the pre-motor filter 256 is sized to cover substantially the entire transverse area of the filter chamber 248, and overlie substantially all of the transverse cross sectional area of the cyclone chamber 162, dirt collection chamber 164 and suction motor 111. Preferably, as illustrated, the pre-motor filter 256 comprises first and second pre-motor filters 256*a*, 256*b*. The filter chamber 248 comprises an air inlet chamber 258 on the upstream side 272 of the pre-motor filter 256, and an air outlet chamber 260 on the opposing downstream side of the pre-motor filter 256. Air can travel from the air inlet chamber 258 to the air outlet chamber 260 by flowing through the pre-motor filter 256.

Preferably, the upstream side of the pre-motor filter is the outward facing face of the pre-motor filter. Accordingly, the air inlet chamber 258 may be fluidly connected to the vortex finder 182 by an inlet conduit 262 that extends through a first aperture 264 in the pre-motor filter 256. The air outlet chamber 260 is in fluid communication with the inlet 246 of the suction motor 111. The pre-motor filter 256 may be supported by a plurality of support ribs 266 extending from the sidewall 116*a* into the air outlet chamber 260. Cutouts can be provided in the ribs 266 to allow air to circulate within the air outlet chamber 266 and flow toward the suction motor inlet 246.

Figure 5:
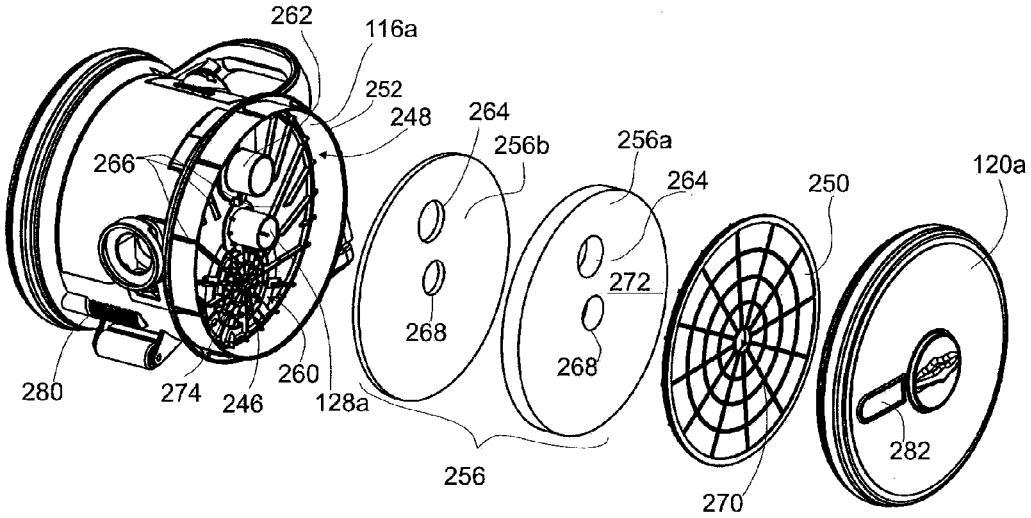
FIG. 5 is a partially exploded view of the surface cleaning apparatus of FIG. 1, with a side wheel, seal plate and pre-motor filter exploded.

In the illustrated example, the axle mount 128*a* for supporting the side wheel 120*a* is provided on the main body 12 and accordingly extends through the air filter chamber 248, a second aperture 268 in the pre-motor filter 256 and through an axle mount aperture 270 in the seal plate 250 (FIG. 5). The axle mount aperture 270 in the seal plate 250 is configured to provide an air-tight seal against the axle mount 128*a*. Optionally, a sealing gasket or the like can be provided at the interface between the seal plate 250 and the axle mount 128*a*. In this configuration the pre-motor filter 256 surrounds the axle mount 128*a*.

In the illustrated example, the seal plate 250 is removable, when the side wheel 120*a* is moved to an open position or detached, to allow a user to access the pre-motor filter 256. Alternatively, instead of being removable, the seal plate 250 can be movably attached to the body 112, for example pivotally connected to the sidewall 116*a*, such that the seal plate 250 can be opened without being completely detached from the body 112.

Preferably, the seal plate 250 is transparent, or at least partially transparent. Providing a transparent seal plate 250 may help facilitate visual inspection of the upstream side 272 of the pre-motor filter 256 while the seal plate 250 is in place. When the seal plate 250 is removed, the pre-motor filter 256 may be removed, for example for cleaning or replacement.

Openable Suction Motor Housing

Figure 6:
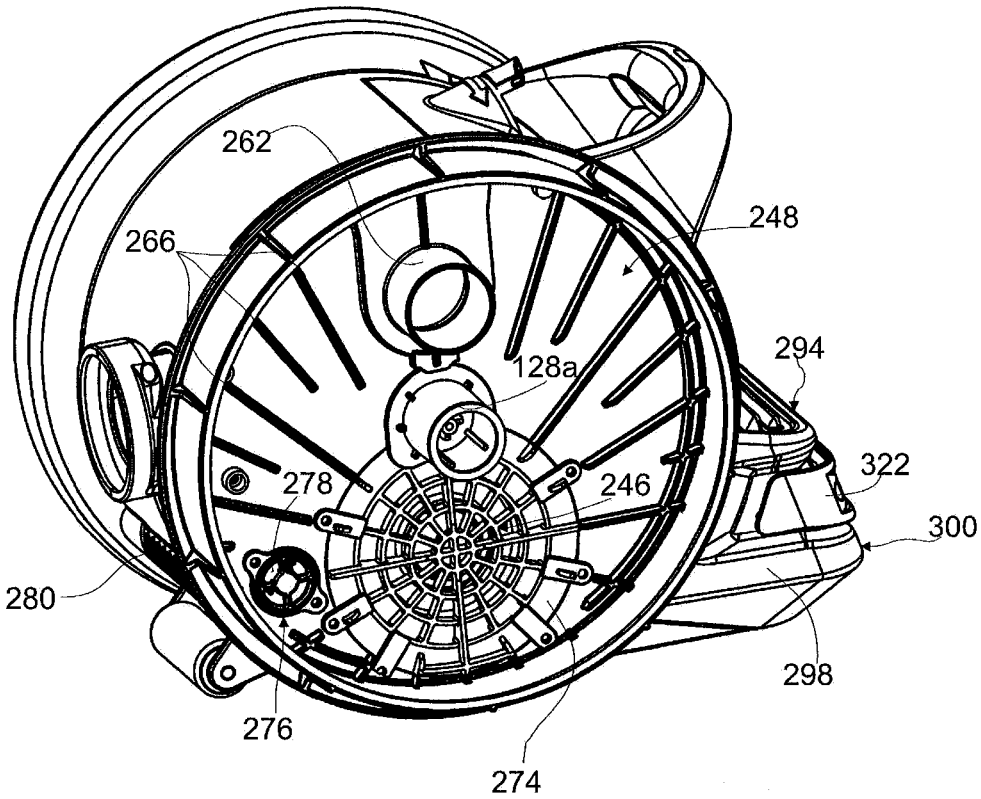
FIG. 6 is a side view of the surface cleaning apparatus of FIG. 1, with a side wheel, cover plate and pre-motor filter removed.

Referring to FIG. 6, optionally a portion of the suction motor housing 210 can be removably connected to the body 112. Preferably, the removable portion 274 of the suction motor housing 210 comprises the suction motor air inlet 246. More preferably, the removable portion 274 of the suction motor housing is large enough to allow access to and/or removal of the suction motor 111 from the body 112. In the illustrated example, the removable portion 274 of the suction motor housing 210, and optionally the suction motor 111, are accessible through the air filter chamber 248 and can be accessed when the seal plate 250 and pre-motor filter 256 are removed. Removable portion 274 may comprise an air intake grill and may be secured to the main body 12 by any means, such as screws or the like.

Bleed Valve

A bleed valve 276 is optionally provided to supply clean air to the suction motor inlet. In the illustrated example a bleed valve air outlet 278 is in fluid communication with the air outlet chamber 260 and can introduce clean air into the air outlet chamber 260 downstream from the pre-motor filter 256. Air introduced by the bleed valve 276 can flow through the optional cutouts in the supporting ribs 266, as described above. The bleed valve 276 may be a pressure sensitive valve that is opened when there is a blockage in the air flow path upstream from the suction motor 111. In the illustrated example, the bleed valve 276 is parallel with the suction motor 111. A bleed valve inlet 280 is provided toward the front of the body 112.

Filter Window in the Side Wheel

Preferably, the side wheel 120*a* covering the seal plate 250 includes at least one transparent region 282. Providing a transparent region 282 in the side wheel 120*a* may allow a user to visually inspect the upstream side 272 pre-motor filter 256 while the side wheel 120*a* is in place. In the illustrated example, the side wheel 120*a* includes a transparent window 282. The transparent window 282 can be sized so that a user can view a desired amount of the pre-motor filter 256 through the window. In the illustrated example, the window 282 is oriented in a generally radial orientation, and extends from the hub 132*a* to the peripheral edge of the side wheel 120*a*. Providing a radially oriented window 282 may allow a user to inspect a relatively large portion of the surface of the pre-motor filter 256 when the side wheel 120*a* is rotated relative to the body 112. Alternatively, instead of being configured in a radial orientation, the window 282 can be configured in an annular configuration (optionally concentrically aligned with the side wheel 120*a*) or other suitable configuration. Optionally, the side wheel 120*a* can include more than one window 282.

It will be appreciated that a filter chamber 248 may be provided alternately, or in addition, for a post motor filter.

Post Motor Filter Housing

Referring to FIGS. 6 and 10, from the suction motor inlet 246, the air is drawn through the suction motor 111 and ejected via a suction motor outlet 284 and into a post-motor filter chamber 286, within the post-motor filter housing 160. The post-motor filter chamber 248 contains an air inlet chamber 288 and an optional post-motor filter 290, including, for example a HEPA filter. In the illustrated example, the post-motor filter chamber 286 also comprises the clean air outlet 104, on the downstream side of the post-motor filter 290. A grill 292 can be used to cover the clear air outlet 104.

The post-motor filter chamber 286 can extend into the body 112 of the surface cleaning apparatus 100. In the illustrated example, a portion of post-motor filter chamber 286 is positioned transversely between the body sidewalls 116*a*, 116*b* and the side wheels 120*a*, 120*b*. Preferably, at least a portion of the post-motor filter 290 is positioned between the sidewalls 116*a*, 116*b* and within the diameter 126 of the side wheels 120*a*, 120*b*. Configuring the post-motor filter chamber 286 to extend between the sidewalls 116*a*, 116*b* and inside the diameter 126 of side wheels 120*a*, 120*b* may help reduce the overall length of the surface cleaning apparatus 100, as opposed to providing the entirety of the post-motor filter chamber 286 outside the diameter 126 of the side wheels 120*a*, 120*b*.

In the example illustrated, an exposed upper wall 294 of the post-motor filter housing 160 has a smaller surface area than the opposing lower wall 296. Preferably, the lower wall 296 or the end wall 300 may be openable to allow access to the post-motor filter 290, for example for inspection and replacement. In the illustrated example, the lower wall 296 is detachable from the post-motor filter housing sidewall 298 to allow access to the post-motor filter 290. A sealing gasket can be provided at the interface between the lower wall and the sidewall to help seal the post-motor filter chamber 248. Providing a removable lower wall 296 or end wall 300 may help facilitate removal of a post-motor filter 290 that has a larger area than the exposed upper wall 294, particularly if the post-motor filter 290 is rigid (for example a HEPA filter cartridge). Optionally, instead of being removable, the lower wall 296 can include an openable door to allow access to the post-motor filter 290. Alternatively, the upper wall 194, sidewall 298 and/or end wall 300 of the post-motor filter housing can be openable to allow access to the post-motor filter 290.

In the example illustrated, the post-motor filter housing 160 is positioned at the rear of the surface cleaning apparatus 100. Alternatively, the post-motor filter housing 160 can be positioned toward the front of the surface cleaning apparatus 100, or at another suitable location on the body 112.

Cord Wind Spool

Referring to FIGS. 7-10, optionally, the surface cleaning apparatus 100 can comprise an internal electrical cord winding apparatus. In the illustrated example, the electrical cord winding apparatus is preferably a powered cord winder apparatus that includes a cord wrap spool 302 and a cord wrap motor 304. An electrical cord that is wrapped around the spool 302 can be drawn through a cord aperture 306 in the body 112 (FIG. 10). Optionally, the cord aperture 306 can include rollers or other guide members to help guide the cord through the aperture 306.

In the example illustrated, the cord wrap spool 302 is rotatably received in a cord wrap chamber 308 (FIG. 7*a*). In the example illustrated the cord wrap chamber 308 comprises a recess in the sidewall 116*b*. Optionally, a cover plate 310 can be connected to the sidewall 116*b* to enclose the cord wrap chamber 308, and contain the cord wrap spool 302. The cover plate 310 may be openable, and is preferably removable to allow a user to access the cord wrap chamber 308.

In the illustrated example, the cord wrap spool 302 is rotatable about axle mount 128*b*, and has a spool axis of rotation 312 that is coincident with the primary axis of rotation 130. The cord wrap spool 302 comprises a mounting collar 314 that is non-rotatably connected to the axle mount 128*b*. Referring to FIG. 9, an inward bearing surface 316 on the spool 302 is slidably supported on a complementary collar bearing surface 318 to allow rotation of the spool 302 relative to the body 112. Alternatively, a roller bearing, ball bearing or other type of bearing apparatus can be provided between the spool 302 and the axle mount 128*b*.

Operation of the cord wrap motor 304 can be controlled by an onboard controller 320 that is triggered by a cord wrap switch 322 (see also FIG. 6). Power for the cord wrap motor 304 can be provided by an onboard power source 324. Providing an onboard power source 324 enables the cord wrap spool 302 to be driven to wind the electrical cord even after the electrical cord has been unplugged from the wall socket. The onboard power source 324 can be any type of portable power source, including, for example, one or more batteries contained in a battery compartment 326. Optionally, the batteries can be rechargeable and may be recharged when the electrical cord is plugged in.

Referring to FIGS. 7 and 8, the controller 320 and onboard power source 324 are located in an accessory chamber 328 defined between the outer surface of the cover plate 310 and the side wheel 120*b*. In the example illustrated, the controller 320 and onboard power source 324 are connected to the outer surface of the cover plate 210.

Referring also to FIG. 9, the cord wrap spool 302 comprises an inner flange 330 and an outer flange 332 to help retain the electrical cord wrapped on the spool 302. The inner surfaces of the flanges 330, 332 are separated by a spool width 334. Preferably, the spool width 334 is selected so that it is not an even multiple of the diameter of the electrical cord, for example a standard 4.5 millimeter diameter electrical cord that is to be wrapped on the spool 302. Selecting a spool width 334 that is not an even multiple of the electrical cord diameter, for example setting the spool width to approximately 12 millimeters, may help reduce binding or jamming of the electrical cord as it is wound, or unwound from the spool 302. Preferably, the spool width is between 10% and 90% of the length of the number of widths of the electrical cord that may fit across the spool, and preferably between 20 and 80%.

In the example illustrated, the peripheral edge of the inner flange 330 comprises a plurality of gear teeth 336. The teeth 336 on the perimeter of the inner flange 330 are configured to mesh with the teeth on a drive sprocket 338 that is coupled to the cord wrap motor 304. In this configuration, rotation of the sprocket 338 of the cord wrap motor 304 can cause rotation of the spool 302. Alternatively, instead of integrating gear teeth on the inner flange 330, the spool 302 can be connected to the cord wrap motor 304 using another drive train apparatus, including, for example, a belt drive and a gear train.

Optionally, the cord wrap motor 304 can include a clutch or other disengagement member to decouple the rotation of the spool 302 and the motor when desired, for example when the electrical cord is being unwound from the spool 302. Alternatively, the cord wrap motor 304 can remain drivingly connected to the spool 302 and may be driven in reverse when a user pulls the cord from the spool 302. In this configuration, the controller 320 can include a protection module to help prevent electrical current generated by the rotating motor from damaging or overloading the controller 320.

The cord wrap switch 322 can be any type of electrical switch, or other type of actuator, accessible to the user of the surface cleaning apparatus 100. In the example illustrated, the cord wrap switch comprises a cord wrap pedal 322 that is electrically connected to the controller 320. The cord wrap pedal 322 is preferably pivotally mounted to the rear end of the post-motor filter housing 160, and can pivot between an "off" position and an "on" position. When the cord wrap pedal 322 is pivoted to the on position, the cord wrap motor 304 is activated and the electrical cord can be wound around the spool 302.

Preferably, the cord wrap pedal 322 is biased toward the off position. Biasing the pedal 322 toward the off position may help prevent the cord wrap switch being inadvertently activated when the surface cleaning apparatus 100 is in use.

Alternatively, instead of a foot-actuated pedal 322, the cord wrap switch can be a button, lever or other type of actuator. Optionally, the cord wrap switch can be configured to be engaged by the hands of a user, instead or, or in addition to, being configured to engage a user's foot.

Optionally, the controller 320 can be configured to operate the cord wrap motor 304 at a generally constant wrap speed. The wrap speed can be selected so that the velocity of the tip of the electrical cord is maintained below a predetermined threshold as the cord is wrapped around the spool 302. For example, the cord wrap motor 304 can be configured to rotate at about 100 rpm, which may help limit the velocity at the tip of the cord to between about 5 meters per second and about 0.5 meters per second, and may allow the electrical cord to be wound in between about 5 seconds and about 30 seconds.

Optionally, the controller 320 can be configured to disengage or deactivate the cord wrap motor 304 if the cord wrap spool 302 becomes jammed or otherwise stops rotating, even while the cord wrap pedal 322 is depressed. In the example illustrated, the controller 320 is configured to monitor the electrical current drawn by the cord wrap motor 304. If the spool 302 stops rotating, the sprocket 338 will stop rotating and the current drawn by the cord wrap motor 304 may increase. In response to such a current increase, the controller 320 can reduce or eliminate the power supplied to the cord wrap motor 304. Reducing the power supplied to a non-rotating motor may help reduce motor burn out. Alternatively, instead of monitoring cord wrap motor current, the controller 320 can be configured to monitor rotation of the spool 302, comprise an end stop sensor or switch, or monitor other suitable factors to help determine when the spool 302 has stopped rotating.

The cord wrap motor 304 can operate continuously while the user depresses the cord wrap pedal 322. Providing a continuous, sustained wrapping motion may help facilitate the wrapping of relatively long electrical cords, for example cords in excess of 5.5 meters feet, around the spool 302. In contrast, known spring biased cord winding spools may not be able to provide the sustained wrapping motion to wrap long cords.

Optionally, a manual drive mechanism can be provided to help wind the cord wrap spool 302 if the onboard power source is depleted. For example, a hand crank or other type of manual actuator can be connected to the spool 302 to enable a user to manually wind in the electrical cord.

It will be appreciated that the following claims are not limited to any specific embodiment disclosed herein. Further, it will be appreciated that any one or more of the features disclosed herein may be used in any particular combination or sub-combination, including, without limitation, the cord spool, the protective sidewalls, the cyclone bin assembly lock, an openable or removable wheel to access a component of the surface cleaning apparatus, the positioning and/or configuration of the post motor filter housing, the use of one or more stabilizer wheels, the seal plate, the pre-motor filter window in a wheel, the openable suction motor housing, the wheel axle extending through the filter, The divided dirt collection chamber with the diverter, the asymmetrical orientation of the dirt outlet 180, the threaded wheels, the passage 220 for the divided dirt collection chamber, the side wheels and positioning an operating component in a sidewall of the main body 112.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

(a) an air flow path extending from a dirty air inlet to a clean air outlet;

(b) a main body comprising a front end, a rear end, first and second opposed sidewalls, a cavity defined between the first and second sidewalls, the cavity having an open upper end, an open front end and an open rear end positioned between the first and second opposed sidewalls and a suction motor provided in the air flow path; and, (c) a cyclone bin assembly provided in the air flow path and being removably mounted in the cavity, the cyclone bin assembly comprising a cyclone chamber having opposed end walls, an air outlet provided in one of the end walls a sidewall extending between the opposed end walls and a cyclone axis about which air circulates within the cyclone chamber, wherein when the cyclone bin assembly is mounted in the cavity the cyclone axis intersects the first and second sidewalls of the main body, the air outlet directing air exiting towards one of the first and second sidewalls, a forward facing portion of the bin sidewall is visible from the front end of the main body and a rearward facing portion of the bin side wall is visible from the rear end of the main body; and wherein each of the first and second opposed sidewalls comprises a wheel having a diameter larger than the diameter of the cyclone chamber.

2. The surface cleaning apparatus of claim 1 the wheels are substantially the same size as the sidewalls.

3. The surface cleaning apparatus of claim 1 wherein the wheels have a cross sectional area larger than a transverse cross sectional area of the cyclone bin assembly.

4. The surface cleaning apparatus of claim 1 wherein the sidewalls overlie essentially all of end walls of the cyclone bin assembly.

5. The surface cleaning apparatus of claim 1 wherein the cyclone bin assembly seats on a platform in the cavity and the platform comprises a portion of a housing for the suction motor.

6. The surface cleaning apparatus of claim 1 wherein the cyclone bin assembly further comprises an openable dirt collection chamber, wherein one of the end walls is an openable wall of the dirt collection chamber.

7. The surface cleaning apparatus of claim 1 wherein the cyclone chamber comprises a tangential inlet that faces the front end of the surface cleaning apparatus.

8. The surface cleaning apparatus of claim 1 wherein the cyclone bin assembly further comprises a dirt collection chamber and the dirt collection chamber is provided exterior to the cyclone chamber and extends at least partially collinearly therewith.

9. The surface cleaning apparatus of claim 1 wherein at least one of the first and second opposed sidewalls has a compartment that houses an operating component of the surface cleaning apparatus or a portion of the air flow path.

10. The surface cleaning apparatus of claim 9 wherein the compartment is openable.

11. The surface cleaning apparatus of claim 10 wherein each of the first and second opposed sidewalls comprises a wheel and at least one of the wheels is openable to reveal the compartment.

12. The surface cleaning apparatus of claim 1, wherein at least one of the first and second opposed sidewalls has a compartment that houses a portion of the air flow path, and wherein the portion of the airflow path comprises at least part of an air flow passage between the cyclone chamber and the suction motor.

13. The surface cleaning apparatus of claim 12 wherein the suction motor extends transversely.

14. The surface cleaning apparatus of claim 12 wherein the compartment houses an operating component of the surface cleaning apparatus, and wherein the operating component comprises at least one of a filter, batteries, a power cord reel and control electronics.

15. The surface cleaning apparatus of claim 1 wherein at least one of the first and second opposed sidewalls has a compartment that houses an operating component of the surface cleaning apparatus, and wherein the operating component comprises at least one of batteries, a power cord reel and control electronics.

16. The surface cleaning apparatus of claim 1 further comprising at least one of a front stabilizer wheel and a rear stabilizer wheel.

17. The surface cleaning apparatus of claim 1 further comprising a front stabilizer wheel and a rear stabilizer wheel wherein the stabilizer wheels are positioned such that only one wheel can contact the floor at a time.

18. The surface cleaning apparatus of claim 1, wherein the bin sidewall further comprises an exposed connecting portion extending between the a forward facing portion and the rearward facing portion.

19. The surface cleaning apparatus of claim 1, wherein when the cyclone bin assembly is mounted within the cavity the cyclone bin assembly overlies at least a portion of the suction motor.

20. A surface cleaning apparatus comprising:

(a) an air flow path extending from a dirty air inlet to a clean air outlet;

(b) a main body comprising a front end, a rear end, a first sidewall and a second sidewall laterally opposed from the first sidewall in a first direction, a first side wheel rotatably coupled to the first sidewall and a second side wheel rotatably coupled to the second sidewall and laterally opposed from the first side wheel, a cavity defined between the first and second sidewalls and a suction motor provided in the air flow path;

(c) a pre-motor filter chamber provided in the air flow path upstream from the suction motor; and, (d) a cyclone bin assembly provided in the air flow path and being removably mounted in the cavity, the cyclone bin assembly having a cyclone chamber having a diameter, an air outlet and a cyclone axis about which air circulates within the cyclone chamber, the cyclone bin assembly having a first end wall and an opposed second end wall comprising the air outlet and being spaced apart from the first end wall in the direction of the cyclone axis, wherein when the cyclone bin assembly is mounted within the cavity the cyclone axis is parallel to the first direction and the air outlet directs air towards and faces the pre-motor filter chamber;

wherein each of the first side wheel and second side wheel has a diameter larger than the diameter of the cyclone chamber.

21. The surface cleaning apparatus of claim 20, wherein the bin side wall is curved and generally follows the curvature of the first and second side wheels.

22. The surface cleaning apparatus of claim 20, wherein the wheels have a cross sectional area taken in a plane generally orthogonal to a rotational axis of the first and side wheel that is substantially the same size as a cross sectional area of the sidewalls taken in the plane.

23. The surface cleaning apparatus of claim 20, wherein the cavity has an open upper end, an open front end and an open rear end, and when the cyclone bin assembly is mounted in the cavity each opposed end wall faces an inner surface of one of the opposed side walls and the bin side wall comprises a first exposed portion at the front end and a second exposed portion at rear end.

24. A surface cleaning apparatus comprising:

(a) an air flow path extending from a dirty air inlet to a clean air outlet;

(b) a main body comprising a front end, a rear end, a first sidewall and a second sidewall laterally opposed from the first sidewall, a first side wheel rotatably coupled to the first sidewall and a second side wheel rotatably coupled to the second sidewall and laterally opposed from the first side wheel, a cavity defined between the first and second sidewalls and a suction motor provided in the air flow path;

(c) a cyclone bin assembly provided in the air flow path and being removably mounted in the cavity;

wherein each of the first side wheel and second side wheel has a diameter larger than the diameter of the cyclone chamber and when the cyclone bin assembly is mounted in the cavity the cyclone chamber is disposed within a cylindrical volume defined laterally between the first and second opposed side wheels; and wherein the cyclone bin assembly further comprises a handle extending from the bin side wall, and the handle extends outside the cylindrical volume defined laterally between the first and second opposed side wheels.

25. The surface cleaning apparatus of claim 20, wherein the cavity has an open front end and an open rear end.

26. The surface cleaning apparatus of claim 20, wherein when the cyclone bin assembly is mounted within the cavity the cyclone bin assembly overlies at least a portion of a suction motor.

27. A surface cleaning apparatus comprising:

(a) an air flow path extending from a dirty air inlet to a clean air outlet;

(b) a main body comprising a front end, a rear end, a first sidewall and a second sidewall laterally opposed from the first sidewall and a platform portion extending between the first and second sidewalls, a cavity defined between the first and second sidewalls and the platform and having an open upper end spaced apart from the platform portion, a suction motor provided in the air flow path and external the cavity, and a pre-motor filter chamber provided in the air flow path upstream from the suction motor;

(c) a first side wheel rotatably coupled to the first sidewall and a second side wheel rotatably coupled to the second sidewall and laterally opposed from the first side wheel, the platform portion overlying at least a portion of the suction motor when the main body is supported by the first and second side wheels; and, (d) a cyclone bin assembly provided in the air flow path and being removably mounted in the cavity, the cyclone bin assembly comprising a cyclone chamber defining a cyclone axis about which air circulates within the cyclone chamber and having opposed end walls spaced apart from each other in the direction of the cyclone axis and a bin side wall extending between the opposed end walls, when the cyclone bin assembly is mounted in the cavity and the surface cleaning apparatus is in use the cyclone bin assembly rests on the platform portion, the cyclone axis intersects the second sidewall and the pre-motor filter chamber, each opposed end wall faces an inner surface of one of the opposed side walls and at least an upper portion of the bin side wall is visible.

28. The surface cleaning apparatus of claim 27, wherein when the cyclone bin assembly is mounted in the cavity the cyclone bin assembly is disposed above and at least partially overlies the suction motor.

29. The surface cleaning apparatus of claim 27, wherein the cavity has an open front end and an open rear end.

* * * * *